US009278538B2

(12) United States Patent
Sakamoto et al.

(10) Patent No.: US 9,278,538 B2
(45) Date of Patent: Mar. 8, 2016

(54) RECORDING APPARATUS

(71) Applicant: SEIKO EPSON CORPORATION, Tokyo (JP)

(72) Inventors: Kazutoshi Sakamoto, Shiojiri (JP); Yoshisada Aoki, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/541,668

(22) Filed: Nov. 14, 2014

(65) Prior Publication Data

US 2015/0174906 A1 Jun. 25, 2015

(30) Foreign Application Priority Data

Dec. 24, 2013 (JP) ..... 2013-265010
Feb. 19, 2014 (JP) ..... 2014-029350

(51) Int. Cl.
*B41J 2/175* (2006.01)
*B41J 29/13* (2006.01)

(52) U.S. Cl.
CPC ..... *B41J 2/175* (2013.01); *B41J 2/17509* (2013.01); *B41J 2/17523* (2013.01); *B41J 29/13* (2013.01)

(58) Field of Classification Search
CPC ..... B41J 2/175; B41J 2/17509; B41J 2/17523
See application file for complete search history.

(56) References Cited

U.S. PATENT DOCUMENTS 6,003,981 A * 12/1999 Cameron ..... B41J 2/175 347/85
7,008,051 B2 3/2006 Akermalm
2005/0088493 A1* 4/2005 Koga ..... B41J 2/17509 347/85

FOREIGN PATENT DOCUMENTS

JP 2013-121659 6/2013

* cited by examiner

*Primary Examiner* — Geoffrey Mruk
(74) *Attorney, Agent, or Firm* — Workman Nydegger

(57) ABSTRACT

A recording apparatus includes a housing; a head; a tube which guides ink which is stored in an ink storage portion disposed on an outside of the housing to the head, and includes a deforming movable portion which deforms to track movement of the head, and a fixed portion which does not deform to track the movement of the head; a bearing portion which bears the deforming movable portion; and a partitioning portion which partitions the deforming movable portion from the fixed portion.

18 Claims, 18 Drawing Sheets

RECORDING APPARATUS

BACKGROUND

1. Technical Field

The present invention relates to a recording apparatus such as an ink jet printer, for example.

2. Related Art

In the related art, an ink jet printer, which performs printing (recording) by ejecting ink from a liquid ejecting head onto a recording medium such as paper, is known as a type of recording apparatus. In a printer of this type, in order to supply ink continually and stably to the liquid ejecting head when performing comparatively large volume printing, a configuration in which the ink is supplied to the liquid ejecting head from an ink tank (a liquid storage portion) with a comparatively large ink storage capacity, through an ink supply tube (a liquid supply tube) is proposed (for example, refer to JP-A-2013-121659).

In a printer of this configuration, the liquid ejecting head is mounted on a carriage, which is provided to be capable of moving reciprocally in a main scanning direction in relation to the paper within the housing. The ink supply tube, which extends from the ink tank that is disposed beside the housing, passes through an opening portion in the front surface of the housing, or a through hole in the side of the housing, enters a movement region of the carriage, and is connected to the liquid ejecting head that is mounted on the carriage.

However, in the printer described above, since it is necessary to route the ink supply tube inside the housing depending on the disposition of the ink tank, there is a problem in that, when the liquid ejecting head moves reciprocally, there is a concern that a portion of the ink supply tube which deforms to track the reciprocal movement of the liquid ejecting head will interfere with the internal components of the housing, and the ink supply tube will sustain wear. Since one end of the portion which is subjected to tracking deformation is fixed to the carriage, there is a problem in that, when the portion which is subjected to tracking deformation interferes with the internal components in the housing, the movement speed of the carriage is influenced and the quality of an image, which is formed on the recording medium by ejecting the ink from the liquid ejecting head, is reduced.

This problem is not limited to an ink jet printer, and is generally common to recording apparatuses which perform recording by ejecting a liquid, which is supplied to the liquid ejecting head in the housing from a liquid storage portion that is disposed on the outside of the housing via a liquid supply tube, from the liquid ejecting head.

SUMMARY

An advantage of some aspects of the invention is to provide a recording apparatus which is capable of suppressing the interference between a member, which is routed within the housing and deforms to track the reciprocal movement of the liquid ejecting head, and the internal components of the opposite side of the member while a partitioning portion is interposed therebetween within the housing.

Hereinafter, means of the invention and operation effects thereof will be described.

According to an aspect of the invention, a recording apparatus includes a housing; a liquid ejecting head which is supported by a carriage provided to be capable of moving reciprocally within the housing and which performs recording by ejecting a liquid onto a recording medium; a liquid supply tube which guides the liquid which is stored in a liquid storage portion disposed on an outside of the housing to the liquid ejecting head, the liquid ejecting head side of which deforms to track the reciprocal movement of the liquid ejecting head, and the liquid storage portion side of which is folded back from the liquid ejecting head side and is not subjected to tracking deformation; a bearing portion which bears a portion of the liquid supply tube which is subjected to tracking deformation; and a partitioning portion which is provided in a region in which the portion of the liquid supply tube which is subjected to tracking deformation and a portion of the liquid supply tube which is not subjected to tracking deformation are disposed running along each other, and partitions the portion of the liquid supply tube which is subjected to tracking deformation from the portion of the liquid supply tube which is not subjected to tracking deformation.

In this configuration, in the liquid supply tube, the portion of the liquid supply tube which is subjected to tracking deformation is partitioned from the portion of the liquid supply tube which is not subjected to tracking deformation by the partitioning portion; thus, it is possible to suppress the interference of the portion of the liquid supply tube which is subjected to tracking deformation with the internal components which are disposed closer to the side of the portion of the liquid supply tube which is not subjected to tracking deformation than the partitioning portion.

In the recording apparatus described above, the bearing portion may also be used as the partitioning portion.

In this configuration, it is possible to reduce the number of components.

In the recording apparatus described above, there may be a plurality of the liquid supply tubes, and the plurality of liquid supply tubes may be connected via a connecting portion.

In this configuration, it is easy to perform the assembly work of the liquid supply tube.

In the recording apparatus described above, a substrate disposition portion in which a substrate is disposed may be provided in the housing, and the portion of the liquid supply tube which is not subjected to tracking deformation may be disposed so as to pass between the partitioning portion and the substrate disposition portion.

In this configuration, when there is little space between the partitioning portion and the substrate disposition portion, it is possible to make effective use of the little space by passing the portion of the liquid supply tube which is not subjected to tracking deformation through the space.

In the recording apparatus described above, a movement restriction member, which restricts the portion of the liquid supply tube which is not subjected to tracking deformation from moving to the side of the portion of the liquid supply tube which is subjected to tracking deformation, may be provided between the partitioning portion and the substrate disposition portion.

In this configuration, it is possible to restrict the portion of the liquid supply tube which is not subjected to tracking deformation from moving to the side of the portion of the liquid supply tube which is subjected to tracking deformation using the movement restriction member.

The recording apparatus described above may further include a cable which supplies power to the liquid ejecting head, and the movement restriction member may be a ferrite core which reduces electromagnetic wave noise of the cable.

In this configuration, it is possible to cause the ferrite core which reduces the electromagnetic wave noise of the cable to also function as the movement restriction member which restricts the portion of the liquid supply tube which is not subjected to tracking deformation from moving to the side of the portion of the liquid supply tube which is subjected to tracking deformation; thus, it is possible to reduce the number of components.

The recording apparatus described above may further include a cable which supplies power to the liquid ejecting head, the cable may be connected to the substrate, and the portion of the liquid supply tube which is not subjected to tracking deformation may be disposed to pass under the cable.

In this configuration, it is possible to restrict the portion of the liquid supply tube which is not subjected to tracking deformation from moving in the height direction using the cable.

In the recording apparatus described above, a movement restriction wall, which restricts the portion of the liquid supply tube which is not subjected to tracking deformation from moving to the substrate disposition portion side, may be provided between the portion of the liquid supply tube which is not subjected to tracking deformation and the substrate disposition portion.

In this configuration, it is possible to restrict the portion of the liquid supply tube which is not subjected to tracking deformation from moving to the substrate disposition portion side using the movement restriction wall; thus, it is possible to suppress the interference between the portion of the liquid supply tube which is not subjected to tracking deformation and the substrate.

In the recording apparatus described above, the liquids from the plurality of liquid storage portions in which different types of liquid are stored may be guided to the liquid ejecting head by the plurality of liquid supply tubes, and one of the portions of the plurality of liquid supply tubes which is not subjected to tracking deformation may be disposed so as to pass between the partitioning portion and the substrate disposition portion.

In this configuration, when there is little space between the partitioning portion and the substrate disposition portion, it is possible to make effective use of the little space by passing one of the portions of the plurality of liquid supply tubes which are not subjected to tracking deformation through the space.

In the recording apparatus described above, the liquids from the plurality of liquid storage portions in which different types of liquid are stored may be guided to the liquid ejecting head by the plurality of liquid supply tubes, and the portions of the plurality of liquid supply tubes which are not subjected to tracking deformation may be formed integrally in a lined-up state and may be disposed so as to pass between the partitioning portion and the substrate disposition portion.

In this configuration, since the portions of the plurality of liquid supply tubes which are not subjected to tracking deformation do not separate from each other, it is possible to easily handle the portions of the plurality of liquid supply tubes which are not subjected to tracking deformation.

In the recording apparatus described above, a cover member may be disposed above the portion of the liquid supply tube which is not subjected to tracking deformation in the housing.

In this configuration, since it is possible to hide at least the portion of the liquid supply tube which is not subjected to tracking deformation using the cover member, it is possible to improve the external appearance.

In the recording apparatus described above, the cover member may be the substrate disposition portion.

In this configuration, since it is possible to hide at least the portion of the liquid supply tube which is not subjected to tracking deformation using the substrate disposition portion, it is possible to improve the external appearance.

The recording apparatus described above may further include an operation panel capable of inclining into which information relating to recording is input, and an inclination mechanism which defines an inclination angle of the operation panel, and the portion of the liquid supply tube which is not subjected to tracking deformation may be disposed in a position which overlaps the inclination mechanism in a direction which intersects the direction of the reciprocal movement of the carriage.

In this configuration, it is possible to increase the length of the portion of the liquid supply tube which is subjected to tracking deformation in a direction which intersects the direction of the reciprocal movement of the carriage. Therefore, it is possible to dispose the liquid supply tube such that the curvature of the portion of the liquid supply tube which is subjected to tracking deformation is reduced. Accordingly, since it is possible to reduce the restoring force of the portion of the liquid supply tube which is subjected to tracking deformation, it is possible to suppress the influence of the restoring force on the movement speed of the carriage. Therefore, it is possible to suppress the reduction in quality of an image which is formed on the recording medium by ejecting the ink from the liquid ejecting head which moves reciprocally.

In the recording apparatus described above, the portion of the liquid supply tube which is not subjected to tracking deformation may be disposed in a position which overlaps the connecting portion in a direction which intersects the direction of the reciprocal movement of the carriage.

In this configuration, it is possible to increase the length of the portion of the liquid supply tube which is subjected to tracking deformation in a direction which intersects the direction of the reciprocal movement of the carriage. Therefore, it is possible to dispose the liquid supply tube such that the curvature of the portion of the liquid supply tube which is subjected to tracking deformation is reduced. Accordingly, since it is possible to reduce the restoring force of the portion of the liquid supply tube which is subjected to tracking deformation, it is possible to suppress the influence of the restoring force on the movement speed of the carriage. Therefore, it is possible to suppress the reduction in quality of an image which is formed on the recording medium by ejecting the ink from the liquid ejecting head which moves reciprocally.

In the recording apparatus described above, the liquids from the plurality of liquid storage portions in which different types of liquid are stored may be guided to the liquid ejecting head by the plurality of liquid supply tubes, and one of the portions of the plurality of liquid supply tubes which is not subjected to tracking deformation may be disposed to run along an opposite side of the partitioning portion from the portions of the liquid supply tubes which are subjected to tracking deformation.

In this configuration, it is possible to make effective use of the little space by passing one of the portions of the plurality of liquid supply tubes which are not subjected to tracking deformation through the space.

In the recording apparatus described above, the liquids from the plurality of liquid storage portions in which different types of liquid are stored may be guided to the liquid ejecting head by the plurality of liquid supply tubes, and the portions of the plurality of liquid supply tubes which are not subjected to tracking deformation may be formed integrally in a lined-up state and may be disposed to run along an opposite side of the partitioning portion from the portions of the liquid supply tubes which are subjected to tracking deformation.

In this configuration, since the portions of the plurality of liquid supply tubes which are not subjected to tracking deformation do not separate from each other, it is possible to easily handle the portions of the plurality of liquid supply tubes which are not subjected to tracking deformation.

According to another aspect of the invention, a recording apparatus includes a housing; a liquid ejecting head which is supported by a carriage provided to be capable of moving reciprocally within the housing and which performs recording by ejecting a liquid onto a recording medium; a liquid supply tube which guides the liquid which is stored in a liquid storage portion disposed on an outside of the housing to the liquid ejecting head, the liquid ejecting head side of which deforms to track the reciprocal movement of the liquid ejecting head, and the liquid storage portion side of which is folded back from the liquid ejecting head side and is not subjected to tracking deformation; a cable which deforms to track the reciprocal movement of the liquid ejecting head and supplies power to the liquid ejecting head; a bearing portion which bears the cable; and a partitioning portion which is provided in a region in which the cable and the portion of the liquid supply tube which is not subjected to tracking deformation are disposed running along each other, and partitions the cable from the portion of the liquid supply tube which is not subjected to tracking deformation.

In this configuration, since the cable is partitioned from the portion of the liquid supply tube which is not subjected to tracking deformation by the partitioning portion, it is possible to suppress the interference of the cable with the internal components which are disposed closer to the side of the portion of the liquid supply tube which is not subjected to tracking deformation than the partitioning portion.

In the recording apparatus described above, the bearing portion may also be used as the partitioning portion.

In this configuration, it is possible to reduce the number of components.

In the recording apparatus described above, there may be a plurality of the liquid supply tubes, and the plurality of liquid supply tubes may be connected via a connecting portion.

In this configuration, it is easy to perform the assembly work of the liquid supply tube.

In the recording apparatus described above, a substrate disposition portion in which a substrate is disposed may be provided in the housing, and the portion of the liquid supply tube which is not subjected to tracking deformation may be disposed so as to pass between the partitioning portion and the substrate disposition portion.

In this configuration, when there is little space between the partitioning portion and the substrate disposition portion, it is possible to make effective use of the little space by passing the portion of the liquid supply tube which is not subjected to tracking deformation through the space.

In the recording apparatus described above, a movement restriction member, which restricts the portion of the liquid supply tube which is not subjected to tracking deformation from moving to the side of the portion of the liquid supply tube which is subjected to tracking deformation, may be provided between the partitioning portion and the substrate disposition portion.

In this configuration, it is possible to restrict the portion of the liquid supply tube which is not subjected to tracking deformation from moving to the side of the portion of the liquid supply tube which is subjected to tracking deformation using the movement restriction member.

In the recording apparatus described above, the movement restriction member may be a ferrite core which reduces electromagnetic wave noise of the cable.

In this configuration, it is possible to cause the ferrite core which reduces the electromagnetic wave noise of the cable to also function as the movement restriction member which restricts the portion of the liquid supply tube which is not subjected to tracking deformation from moving to the side of the portion of the liquid supply tube which is subjected to tracking deformation; thus, it is possible to reduce the number of components.

In the recording apparatus described above, the cable may be connected to the substrate, and the portion of the liquid supply tube which is not subjected to tracking deformation may be disposed to pass under the cable.

In this configuration, it is possible to restrict the portion of the liquid supply tube which is not subjected to tracking deformation from moving in the height direction using the cable.

In the recording apparatus described above, a movement restriction wall, which restricts the portion of the liquid supply tube which is not subjected to tracking deformation from moving to the substrate disposition portion side, may be provided between the portion of the liquid supply tube which is not subjected to tracking deformation and the substrate disposition portion.

In this configuration, it is possible to restrict the portion of the liquid supply tube which is not subjected to tracking deformation from moving to the substrate disposition portion side using the movement restriction wall; thus, it is possible to suppress the interference between the portion of the liquid supply tube which is not subjected to tracking deformation and the substrate.

In the recording apparatus described above, the liquids from the plurality of liquid storage portions in which a plurality of different types of liquid are stored may be guided to the liquid ejecting head by the plurality of liquid supply tubes, and one of the portions of the plurality of liquid supply tubes which is not subjected to tracking deformation may be disposed so as to pass between the partitioning portion and the substrate disposition portion.

In this configuration, when there is little space between the partitioning portion and the substrate disposition portion, it is possible to make effective use of the little space by passing one of the portions of the plurality of liquid supply tubes which are not subjected to tracking deformation through the space.

In the recording apparatus described above, the liquids from the plurality of liquid storage portions in which different types of liquid are stored may be guided to the liquid ejecting head by the plurality of liquid supply tubes, and the portions of the plurality of liquid supply tubes which are not subjected to tracking deformation may be formed integrally in a lined-up state and may be disposed so as to pass between the partitioning portion and the substrate disposition portion.

In this configuration, since the portions of the plurality of liquid supply tubes which are not subjected to tracking deformation do not separate from each other, it is possible to easily handle the portions of the plurality of liquid supply tubes which are not subjected to tracking deformation.

In the recording apparatus described above, a cover member may be disposed above the portion of the liquid supply tube which is not subjected to tracking deformation in the housing.

In this configuration, since it is possible to hide at least the portion of the liquid supply tube which is not subjected to tracking deformation using the cover member, it is possible to improve the external appearance.

In the recording apparatus described above, the cover member may be the substrate disposition portion.

In this configuration, since it is possible to hide at least the portion of the liquid supply tube which is not subjected to tracking deformation using the substrate disposition portion, it is possible to improve the external appearance.

The recording apparatus described above may further include an operation panel capable of inclining into which information relating to recording is input, and an inclination mechanism which defines an inclination angle of the operation panel, and the portion of the liquid supply tube which is not subjected to tracking deformation may be disposed in a position which overlaps the inclination mechanism in a direction which intersects the direction of the reciprocal movement of the carriage.

In this configuration, it is possible to increase the length of the portion of the liquid supply tube which is subjected to tracking deformation in a direction which intersects the direction of the reciprocal movement of the carriage. Therefore, it is possible to dispose the liquid supply tube such that the curvature of the portion of the liquid supply tube which is subjected to tracking deformation is reduced. Accordingly, since it is possible to reduce the restoring force of the portion of the liquid supply tube which is subjected to tracking deformation, it is possible to suppress the influence of the restoring force on the movement speed of the carriage. Therefore, it is possible to suppress the reduction in quality of an image which is formed on the recording medium by ejecting the ink from the liquid ejecting head which moves reciprocally.

In the recording apparatus described above, the portion of the liquid supply tube which is not subjected to tracking deformation may be disposed in a position which overlaps the connecting portion in a direction which intersects the direction of the reciprocal movement of the carriage.

In this configuration, it is possible to increase the length of the portion of the liquid supply tube which is subjected to tracking deformation in a direction which intersects the direction of the reciprocal movement of the carriage. Therefore, it is possible to dispose the liquid supply tube such that the curvature of the portion of the liquid supply tube which is subjected to tracking deformation is reduced. Accordingly, since it is possible to reduce the restoring force of the portion of the liquid supply tube which is subjected to tracking deformation, it is possible to suppress the influence of the restoring force on the movement speed of the carriage. Therefore, it is possible to suppress the reduction in quality of an image which is formed on the recording medium by ejecting the ink from the liquid ejecting head which moves reciprocally.

In the recording apparatus described above the liquids from the plurality of liquid storage portions in which different types of liquid are stored may be guided to the liquid ejecting head by the plurality of liquid supply tubes, and one of the portions of the plurality of liquid supply tubes which is not subjected to tracking deformation may be disposed to run along an opposite side of the partitioning portion from the portions of the liquid supply tubes which are subjected to tracking deformation.

In this configuration, it is possible to make effective use of the little space by passing one of the portions of the plurality of liquid supply tubes which are not subjected to tracking deformation through the space.

In the recording apparatus described above, the liquids from the plurality of liquid storage portions in which different types of liquid are stored may be guided to the liquid ejecting head by the plurality of liquid supply tubes, and the portions of the plurality of liquid supply tubes which are not subjected to tracking deformation may be formed integrally in a lined-up state and may be disposed to run along an opposite side of the partitioning portion from the portions of the liquid supply tubes which are subjected to tracking deformation.

In this configuration, since the portions of the plurality of liquid supply tubes which are not subjected to tracking deformation do not separate from each other, it is possible to easily handle the portions of the plurality of liquid supply tubes which are not subjected to tracking deformation.

According to still another aspect of the invention, a recording apparatus includes a housing; a liquid ejecting head which is supported by a carriage provided to be capable of moving reciprocally within the housing and which performs recording by ejecting a liquid onto a recording medium; a liquid supply tube which guides the liquid which is stored in a liquid storage portion disposed on an outside of the housing to the liquid ejecting head, the liquid ejecting head side of which deforms to track the reciprocal movement of the liquid ejecting head, and the liquid storage portion side of which is folded back from the liquid ejecting head side and is not subjected to tracking deformation; a protective member which deforms to track the reciprocal movement of the liquid ejecting head and protects the portion of the liquid supply tube which is subjected to tracking deformation; a bearing portion which bears the protective member; and a partitioning portion which is provided in a region in which the protective member and the portion of the liquid supply tube which is not subjected to tracking deformation are disposed running along each other, and partitions the protective member from the portion of the liquid supply tube which is not subjected to tracking deformation.

In this configuration, since the protective member is partitioned from the portion of the liquid supply tube which is not subjected to tracking deformation by the partitioning portion, it is possible to suppress the interference of the protective member with the internal components which are disposed closer to the side of the portion of the liquid supply tube which is not subjected to tracking deformation than the partitioning portion.

In the recording apparatus described above, the bearing portion may also be used as the partitioning portion.

In this configuration, it is possible to reduce the number of components.

In the recording apparatus described above, there may be a plurality of the liquid supply tubes, and the plurality of liquid supply tubes may be connected via a connecting portion.

In this configuration, it is easy to perform the assembly work of the liquid supply tube.

In the recording apparatus described above, a substrate disposition portion in which a substrate is disposed may be provided in the housing, and the portion of the liquid supply tube which is not subjected to tracking deformation may be disposed so as to pass between the partitioning portion and the substrate disposition portion.

In this configuration, when there is little space between the partitioning portion and the substrate disposition portion, it is possible to make effective use of the little space by passing the portion of the liquid supply tube which is not subjected to tracking deformation through the space.

In the recording apparatus described above, a movement restriction member, which restricts the portion of the liquid supply tube which is not subjected to tracking deformation from moving to the side of the portion of the liquid supply tube which is subjected to tracking deformation, may be provided between the partitioning portion and the substrate disposition portion.

In this configuration, it is possible to restrict the portion of the liquid supply tube which is not subjected to tracking deformation from moving to the side of the portion of the liquid supply tube which is subjected to tracking deformation using the movement restriction member.

The recording apparatus described above may further include a cable which supplies power to the liquid ejecting head, and the movement restriction member may be a ferrite core which reduces electromagnetic wave noise of the cable.

In this configuration, it is possible to cause the ferrite core which reduces the electromagnetic wave noise of the cable to also function as the movement restriction member which restricts the portion of the liquid supply tube which is not subjected to tracking deformation from moving to the side of the portion of the liquid supply tube which is subjected to tracking deformation; thus, it is possible to reduce the number of components.

The recording apparatus described above may further include a cable which supplies power to the liquid ejecting head, the cable may be connected to the substrate, and the portion of the liquid supply tube which is not subjected to tracking deformation may be disposed to pass under the cable.

In this configuration, it is possible to restrict the portion of the liquid supply tube which is not subjected to tracking deformation from moving in the height direction using the cable.

In the recording apparatus described above, a movement restriction wall, which restricts the portion of the liquid supply tube which is not subjected to tracking deformation from moving to the substrate disposition portion side, may be provided between the portion of the liquid supply tube which is not subjected to tracking deformation and the substrate disposition portion.

In this configuration, it is possible to restrict the portion of the liquid supply tube which is not subjected to tracking deformation from moving to the substrate disposition portion side using the movement restriction wall; thus, it is possible to suppress the interference between the portion of the liquid supply tube which is not subjected to tracking deformation and the substrate.

In the recording apparatus described above, the liquids from the plurality of liquid storage portions in which different types of liquid are stored may be guided to the liquid ejecting head by the plurality of liquid supply tubes, and one of the portions of the plurality of liquid supply tubes which is not subjected to tracking deformation may be disposed so as to pass between the partitioning portion and the substrate disposition portion.

In this configuration, when there is little space between the partitioning portion and the substrate disposition portion, it is possible to make effective use of the little space by passing one of the portions of the plurality of liquid supply tubes which are not subjected to tracking deformation through the space.

In the recording apparatus described above, the liquids from the plurality of liquid storage portions in which different types of liquid are stored may be guided to the liquid ejecting head by the plurality of liquid supply tubes, and the portions of the plurality of liquid supply tubes which are not subjected to tracking deformation may be formed integrally in a lined-up state and may be disposed so as to pass between the partitioning portion and the substrate disposition portion.

In this configuration, since the portions of the plurality of liquid supply tubes which are not subjected to tracking deformation do not separate from each other, it is possible to easily handle the portions of the plurality of liquid supply tubes which are not subjected to tracking deformation.

In the recording apparatus described above, a cover member may be disposed above the portion of the liquid supply tube which is not subjected to tracking deformation in the housing.

In this configuration, since it is possible to hide at least the portion of the liquid supply tube which is not subjected to tracking deformation using the cover member, it is possible to improve the external appearance.

In the recording apparatus described above, the cover member may be the substrate disposition portion.

In this configuration, since it is possible to hide at least the portion of the liquid supply tube which is not subjected to tracking deformation using the substrate disposition portion, it is possible to improve the external appearance.

The recording apparatus described above may further include an operation panel capable of inclining into which information relating to recording is input, and an inclination mechanism which defines an inclination angle of the operation panel, and the portion of the liquid supply tube which is not subjected to tracking deformation may be disposed in a position which overlaps the inclination mechanism in a direction which intersects the direction of the reciprocal movement of the carriage.

In this configuration, it is possible to increase the length of the portion of the liquid supply tube which is subjected to tracking deformation in a direction which intersects the direction of the reciprocal movement of the carriage. Therefore, it is possible to dispose the liquid supply tube such that the curvature of the portion of the liquid supply tube which is subjected to tracking deformation is reduced. Accordingly, since it is possible to reduce the restoring force of the portion of the liquid supply tube which is subjected to tracking deformation, it is possible to suppress the influence of the restoring force on the movement speed of the carriage. Therefore, it is possible to suppress the reduction in quality of an image which is formed on the recording medium by ejecting the ink from the liquid ejecting head which moves reciprocally.

In the recording apparatus described above, the portion of the liquid supply tube which is not subjected to tracking deformation may be disposed in a position which overlaps the connecting portion in a direction which intersects the direction of the reciprocal movement of the carriage.

In this configuration, it is possible to increase the length of the portion of the liquid supply tube which is subjected to tracking deformation in a direction which intersects the direction of the reciprocal movement of the carriage. Therefore, it is possible to dispose the liquid supply tube such that the curvature of the portion of the liquid supply tube which is subjected to tracking deformation is reduced. Accordingly, since it is possible to reduce the restoring force of the portion of the liquid supply tube which is subjected to tracking deformation, it is possible to suppress the influence of the restoring force on the movement speed of the carriage. Therefore, it is possible to suppress the reduction in quality of an image which is formed on the recording medium by ejecting the ink from the liquid ejecting head which moves reciprocally.

In the recording apparatus described above the liquids from the plurality of liquid storage portions in which different types of liquid are stored may be guided to the liquid ejecting head by the plurality of liquid supply tubes, and one of the portions of the plurality of liquid supply tubes which is not subjected to tracking deformation may be disposed to run along an opposite side of the partitioning portion from the portions of the liquid supply tubes which are subjected to tracking deformation.

In this configuration, it is possible to make effective use of the little space by passing one of the portions of the plurality of liquid supply tubes which are not subjected to tracking deformation through the space.

In the recording apparatus described above, the liquids from the plurality of liquid storage portions in which different types of liquid are stored may be guided to the liquid ejecting head by the plurality of liquid supply tubes, and the portions of the plurality of liquid supply tubes which are not subjected to tracking deformation may be formed integrally in a lined-up state and may be disposed to run along an opposite side of the partitioning portion from the portions of the liquid supply tubes which are subjected to tracking deformation.

In this configuration, since the portions of the plurality of liquid supply tubes which are not subjected to tracking deformation do not separate from each other, it is possible to easily handle the portions of the plurality of liquid supply tubes which are not subjected to tracking deformation.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
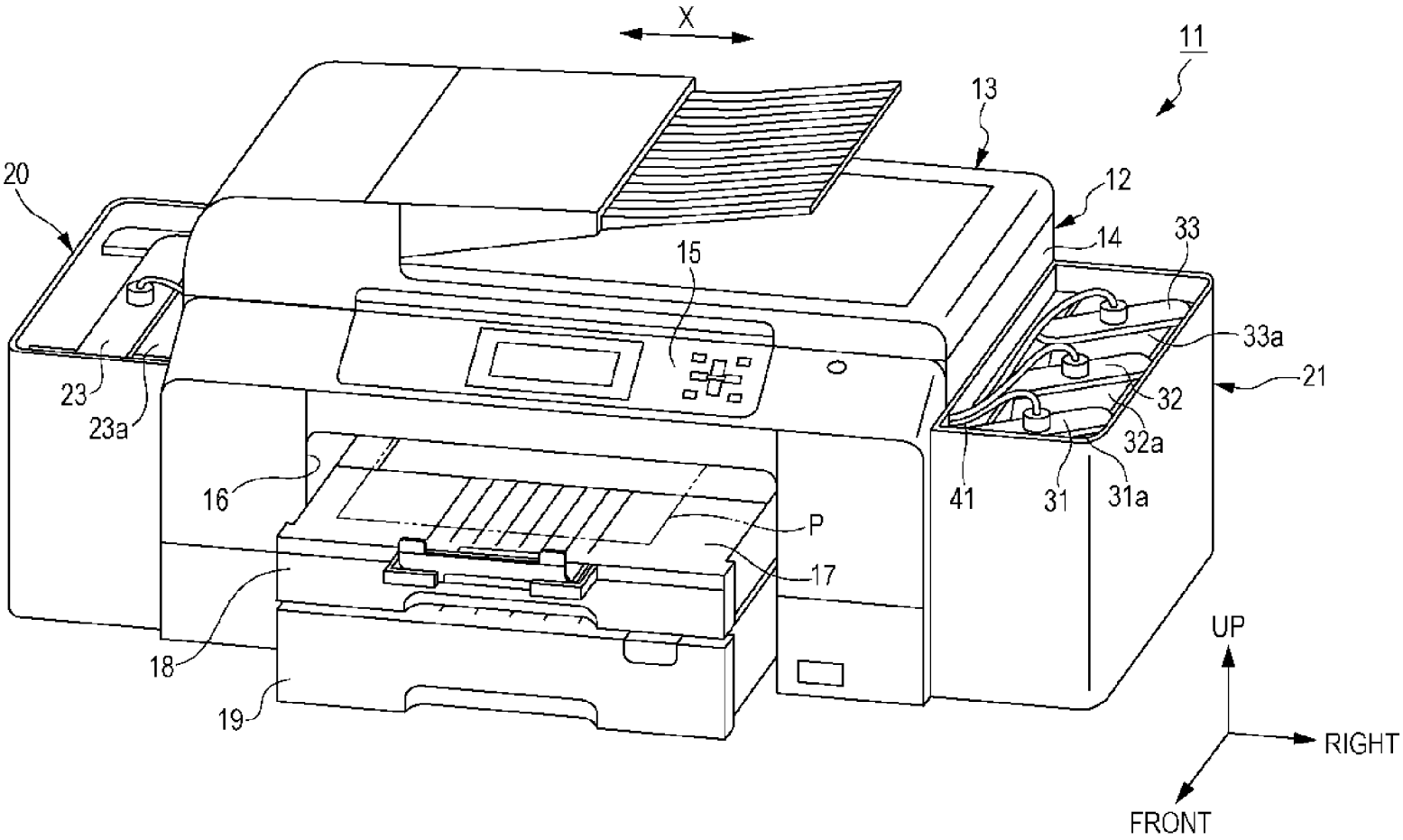
FIG. 1 is a perspective view of a multi-function printer.

Hereinafter, description will be given of a multi-function printer which includes an ink jet printer, which is an example of the recording apparatus according to the first embodiment, with reference to the drawings. As illustrated in FIG. 1, a multi-function printer 11 has an overall substantially cuboid shape and is provided with an ink jet printer 12, which is an example of the recording apparatus that performs printing (recording) by ejecting ink which is an example of the liquid onto paper P which is an example of the recording medium, and a scanner 13 which is disposed on the ink jet printer 12 and reads documents and the like. The ink jet printer 12 is provided with a cuboid housing 14, and an operation unit 15 for performing the various operations of the multi-function printer 11 is provided on the top end portion of the front end portion of the housing 14.

In the upper portion of the front surface of the housing 14, a rectangular output port 16 from which the paper P, which is printed on within the housing 14, is output is open. A rectangular output tray 17 which supports the paper P which is output from the output port 16 extends from the output port 16 to protrude toward the front. Upper and lower level feed cassettes 18 and 19 are detachably mounted to the bottom side of the output tray 17 in the front surface of the housing 14. Different sizes of the paper P are stored in a stacked state in each of the feed cassettes 18 and 19. Naturally, the same sizes of the paper P may be stored in a stacked state in each of the feed cassettes 18 and 19.

Figure 2:
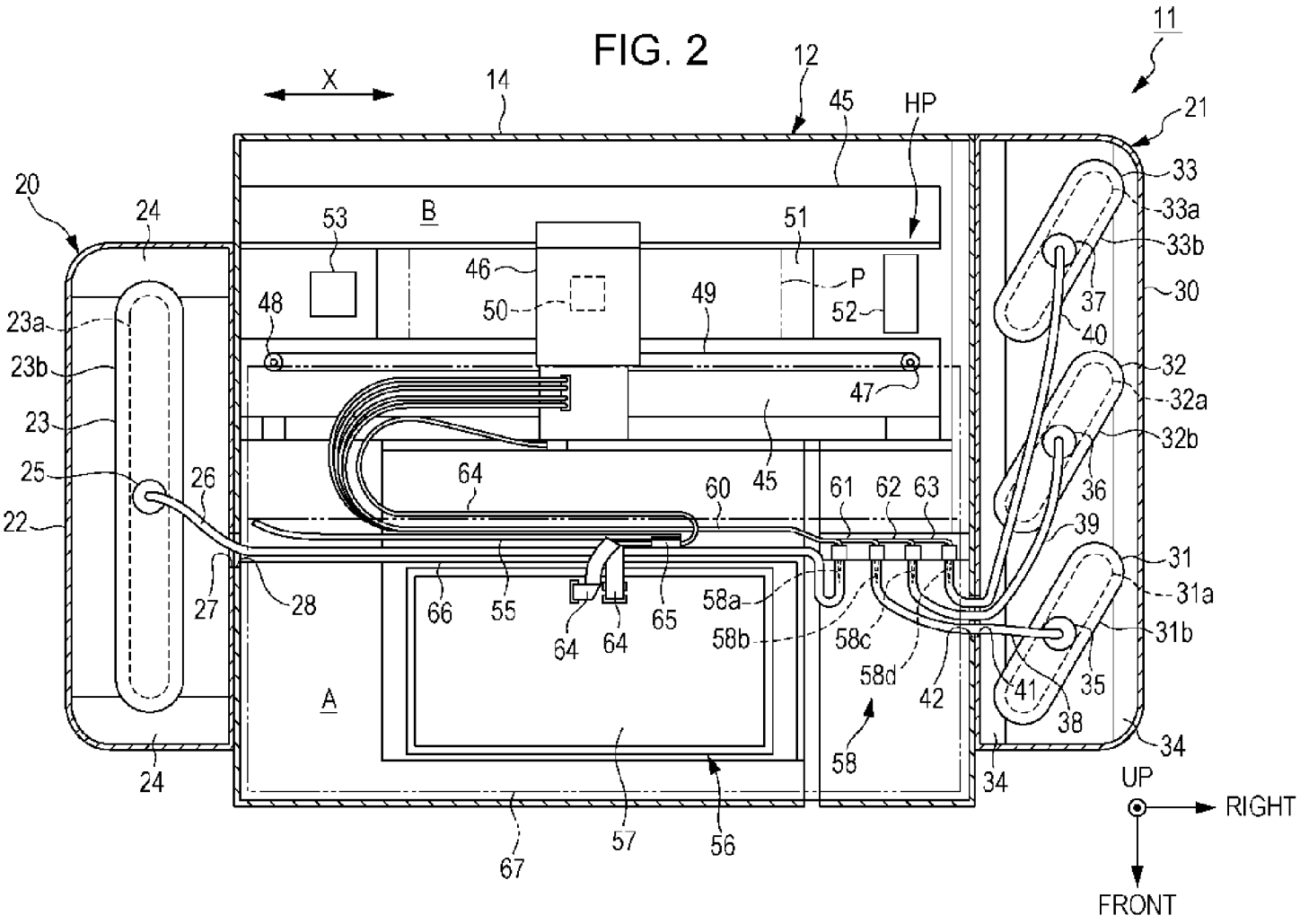
FIG. 2 is a cross-sectional schematic plan view illustrating the inside of an ink jet printer.

As illustrated in FIGS. 1 and 2, a first ink storage portion 20 which is an example of the liquid storage portion is attached to the left side which is one side of the housing 14, and a second ink storage portion 21 which is an example of the liquid storage portion is attached to the right side which is the other side of the housing 14. In other words, the first ink storage portion 20 and the second ink storage portion 21 are disposed on the outside of the housing 14.

The first ink storage portion 20 is provided with a first case 22 and a first ink storage body 23. The first case 22 has the shape of a box which is open at the top end, has a bottom, and has a rectangular shape that is long in the front-rear direction. The first ink storage body 23 is housed in the first case 22. Flange portions 24 are provided on both end portions in the longitudinal direction of the top end portion within the first case 22.

The first ink storage body 23 includes a first ink pouch 23*a* which is filled with black ink, and a substantially rectangular first supporting plate 23*b* which is attached to the top end portion of the first ink pouch 23*a*. The first ink storage body 23 is housed in the first case 22 in a state in which each end portion in the longitudinal direction of the first supporting plate 23*b* is mounted on each of the flange portions 24 of the first case 22. In other words, the first ink storage body 23 is housed in the first case 22 such that the first ink pouch 23*a* is hung from the first supporting plate 23*b* in the first case 22.

A first ink outlet portion 25 for allowing the black ink within the first ink pouch 23*a* to flow out is provided on the center portion of the top surface of the first supporting plate 23*b*. One end side of a first ink outlet tube 26 is connected to the first ink outlet portion 25, the other end side of the first ink outlet tube 26 passes through a through hole 27 which is formed in the side wall of the first case 22 on the housing 14 side, through a through hole 28 which is formed in the side wall of the housing 14 on the first case 22 side, and is inserted into the housing 14.

The second ink storage portion 21 is provided with a second case 30 and second to fourth ink storage bodies 31 to 33. The second case 30 has the shape of a box which is open at the top end, has a bottom, and has a rectangular shape that is long in the front-rear direction. The second to the fourth ink storage bodies 31 to 33 are housed in the second case 30 so as to line up in the front-rear direction. Flange portions 34 are provided on both end portions in the short direction of the top end portion within the second case 30 to extend across the entire longitudinal direction. The second to the fourth ink storage bodies 31 to 33 are set to be smaller than the first ink storage body 23.

The second to the fourth ink storage bodies 31 to 33 are respectively provided with second to fourth ink pouches 31*a* to 33*a*, and substantially rectangular second to fourth supporting plates 31*b* to 33*b* which are attached to the top end portions of the second to the fourth ink pouches 31*a* to 33*a*. The second ink pouch 31*a*, the third ink pouch 32*a*, and the fourth ink pouch 33*a* are filled with a cyan ink, a magenta ink, and a yellow ink, respectively. Therefore, the inks which are stored in the second to the fourth ink storage bodies 31 to 33 of the second ink storage portion 21 are different colors (types) from the ink which is stored in the first ink storage body 23 of the first ink storage portion 20.

The second to the fourth ink storage bodies 31 to 33 are housed in the second case 30 in a state in which each end portion in the longitudinal direction of the second to the fourth supporting plates 31*b* to 33*b* is mounted on each of the flange portions 34 of the second case 30. In other words, the second to the fourth ink storage bodies 31 to 33 are housed in the second case 30 such that the second to the fourth ink pouches 31*a* to 33*a* are hung from the second to the fourth supporting plates 31*b* to 33*b* in the second case 30.

In this case, the second to the fourth ink storage bodies 31 to 33 are stored in the second case 30 so as to line up from the from side toward the rear side in order of the second ink storage body 31, the third ink storage body 32, and the fourth ink storage body 33. Second to fourth ink outlet portions 35 to 37 for allowing the inks within the second to the fourth ink pouches 31*a* to 33*a* to flow out are provided on the center portions of the top surfaces of the second to the fourth supporting plates 31*b* to 33*b*.

One end side of each of second to fourth ink outlet tubes 38 to 40 is connected to the second to the fourth ink outlet portions 35 to 37, respectively. Meanwhile, the other end sides of the second to the fourth ink outlet tubes 38 to 40 pass through a through hole 41 which is formed in the side wall of the second case 30 on the housing 14 side, through a through hole 42 which is formed in the side wall of the housing 14 on the second case 30 side, and is inserted into the housing 14.

As illustrated in FIG. 2, a pair of guide rails 45 is provided on the rear portion inside the housing 14, each guide rail 45 to the front or the rear of the other, so as to extend in the left-right direction. Above the pair of guide rails 45, a carriage 46 is disposed so as to bridge over the pair of guide rails 45. In other words, the carriage 46 is supported by the pair of guide rails 45 so as to be capable of moving reciprocally while being guided along the pair of guide rails 45. The direction of reciprocal movement of the carriage 46 is the main scanning direction X; and, in the present embodiment, the left-right direction matches the main scanning direction X.

A follower pulley 47 is provided on one end side in the main scanning direction X (the end portion of the second ink storage portion 21 side) of the guide rail 45 of the front side, of the pair of guide rails 45, and a drive pulley 48 which can be rotationally driven by a carriage motor (not shown) is provided on the other end side (the end portion of the first ink storage portion 20 side).

An endless timing belt 49 is wrapped around both the pulleys 47 and 48, and a portion of the timing belt 49 is joined to a portion of the carriage 46. Therefore, when the drive pulley 48 is rotationally driven by the driving of the carriage motor (not shown), the drive force is transmitted to the carriage 46 via the timing belt 49, and the carriage 46 moves reciprocally in the main scanning direction X.

A liquid ejecting head 50 is supported on the bottom end portion of the carriage 46 and is capable of ejecting each color of the ink which is supplied from the first ink storage portion 20 and the second ink storage portion 21. A support stand 51 is disposed in a position which opposes the liquid ejecting head 50 in the housing 14 and supports the paper which is selectively fed from the feed cassette 18 or 19 (refer to FIG. 1).

The printing onto the paper P is carried out by ejecting each color of ink onto the paper P on the support stand 51 from a plurality of nozzles (not shown) which are open on the lower surface of the liquid ejecting head 50 while the carriage 46 moves in the main scanning direction X.

One end portion in the main scanning direction X (the end portion of the second ink storage portion 21 side) in the movement region of the carriage 46 is set to a home position HP region in which the carriage 46 rests, and a cap 52 or the like for performing maintenance such as cleaning of the liquid ejecting head 50 is disposed in the home position HP region.

Meanwhile, a flushing box 53 is disposed at the other end portion in the main scanning direction X (the end portion of the opposite side from the home position HP) in the movement region of the carriage 46. The flushing box 53 is for receiving the flushed ink from a flushing operation in which ink is discharged in a context that is unrelated to the printing from the nozzles (not shown) of the liquid ejecting head 50 during the printing of the paper P.

Figure 3:
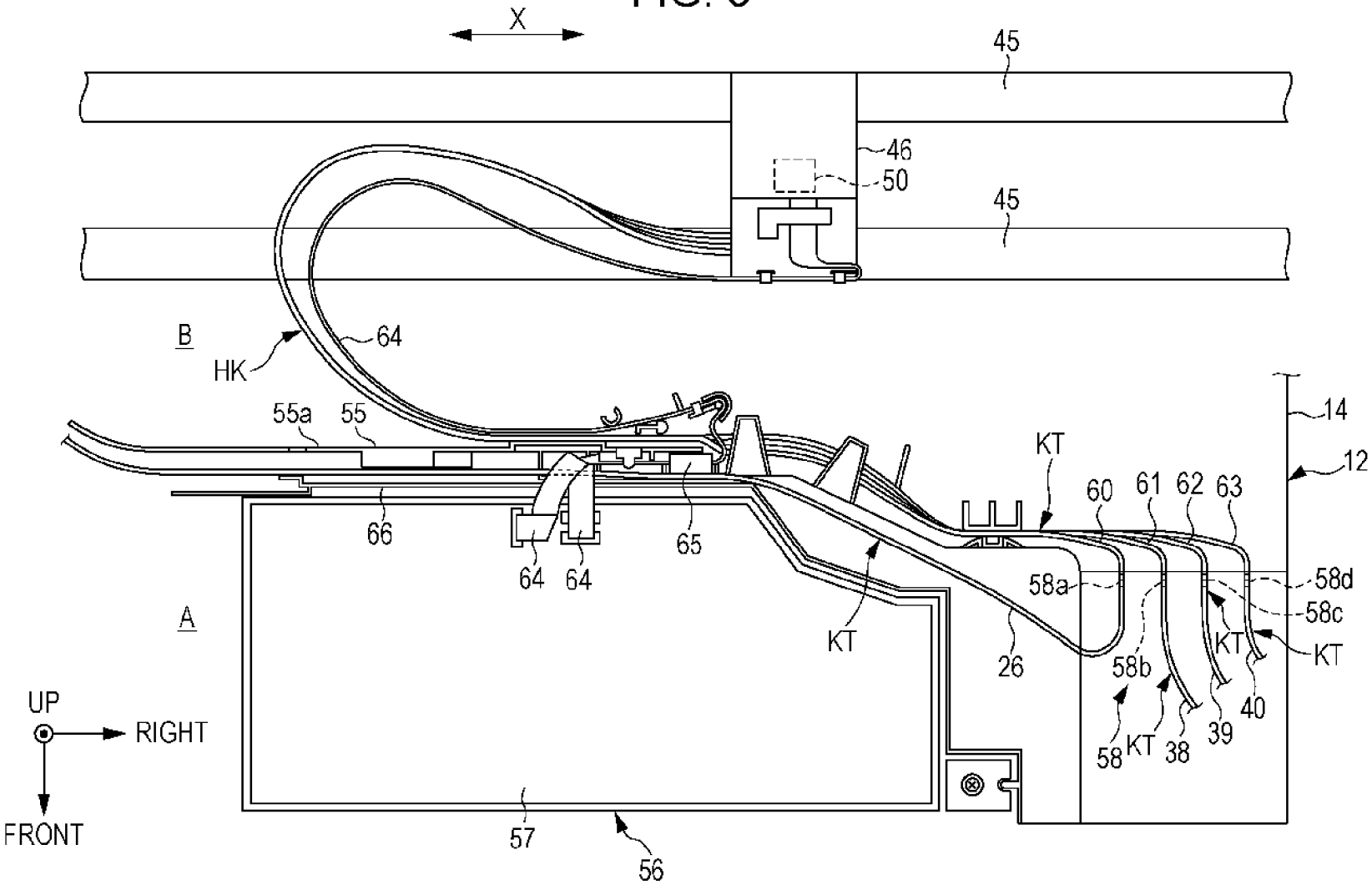
FIG. 3 is an enlarged schematic view of the main components of FIG. 2.

As illustrated in FIGS. 2 and 3, a wall-shaped partitioning portion 55 is provided to extend along the main scanning direction X in the housing 14 in order to partition a first region A from a second region B. The first region A does not include the movement region of the carriage 46, and the second region B does include the movement region of the carriage 46. The partitioning portion 55 extends from the end portion of the first ink storage portion 20 side in the housing 14 toward the second ink storage portion 21 side. In this case, the end portion of the second ink storage portion 21 side of the partitioning portion 55 reaches a position which is slightly closer to the second ink storage portion 21 side than the center portion in the housing 14.

A substrate disposition portion 56 is provided in the center portion of the first region A, which is a region closer to the front side than the partitioning portion 55 in the housing 14, and a substrate 57 is disposed in the substrate disposition portion 56. A tube connecting portion 58 is disposed on the end portion of the home position HP side in the main scanning direction X in the first region A. The tube connecting portion 58 is an example of the connecting portion, in which first to fourth ink supply needles 58*a* to 58*d* which are vacant are provided to line up in the main scanning direction X.

In the first to fourth ink outlet tubes 26 and 38 to 40, one end side of each is connected to the respective first to the fourth ink storage bodies 23 and 31 to 33, the other end side is connected to one end side of the first to the fourth ink supply needles 58*a* to 58*d*.

In other words, the first to the fourth ink outlet tubes 26 and 38 to 40 connect the first to the fourth ink storage bodies 23 and 31 to 33 to the first to the fourth ink supply needles 58*a* to 58*d*, respectively. Therefore, a black ink, a cyan ink, a magenta ink, and a yellow ink are guided respectively by the first to the fourth ink outlet tubes 26 and 38 to 40, from the first to the fourth ink storage bodies 23 and 31 to 33, to the first to the fourth ink supply needles 58*a* to 58*d* of the tube connecting portion 58 in the housing 14.

Meanwhile, in first to fourth ink supply tubes 60 to 63, one end side of each is connected to the liquid ejecting head 50 in a state of being supported by the carriage 46, and the other end side is connected to other end side of the first to the fourth ink supply needles 58*a* to 58*d*. In other words, the first to the fourth ink supply tubes 60 to 63 connect the first to the fourth ink supply needles 58*a* to 58*d* with the liquid ejecting head 50.

The first to the fourth ink supply tubes 60 to 63 guide the black ink, the cyan ink, the magenta ink, and the yellow ink, which are guided by the first to the fourth ink outlet tubes 26 and 38 to 40 from the first to the fourth ink storage bodies 23 and 31 to 33 to the first to the fourth ink supply needles 58*a* to 58*d*, to the liquid ejecting head 50. Note that, in the present embodiment, the liquid supply tubes are configured of the first to the fourth ink supply tubes 60 to 63 and the first to the fourth ink outlet tubes 26 and 38 to 40.

The first to the fourth ink outlet tubes 26 and 38 to 40 respectively communicate with the first to the fourth ink supply needles 60 to 63 via the first to the fourth ink supply needles 58*a* to 58*d*. Therefore, the inks, which are guided by the first to the fourth ink outlet tubes 26 and 38 to 40 from the first to the fourth ink storage bodies 23 and 31 to 33 to the first to the fourth ink supply needles 58*a* to 58*d* of the tube connecting portion 58, are guided to the liquid ejecting head 50 by the first to the fourth ink supply tubes 60 to 63.

The first to the fourth ink supply tubes 60 to 63 are flexible, extend from the first to the fourth ink supply needles 58*a* to 58*d* toward the partitioning portion 55, and extend to the first ink storage portion 20 side along the surface of the second region B side of the partitioning portion 55. Subsequently, the first to the fourth ink supply tubes 60 to 63 extend to the liquid ejecting head 50, which is supported by the carriage 46, bending so as to bulge to the first ink storage portion 20 side while heading toward the movement region of the carriage 46 from the surface of the second region B side of the partitioning portion 55.

The portions of the first to the fourth ink supply tubes 60 to 63 which deform to track the reciprocal movement of the liquid ejecting head 50 (the carriage 46) are defined as deforming movable portions HK of the liquid supply tubes. The surface of the second region B side (the carriage 46 side) of the partitioning portion 55 is a bearing portion 55*a* which bears the deforming movable portions HK when the deforming movable portions HK deform to track the reciprocal movement of the liquid ejecting head 50 (the carriage 46).

Meanwhile, the portions of the first to the fourth ink supply tubes 60 to 63 which do not deform to track the reciprocal movement of the liquid ejecting head 50 (the carriage 46) and the first to the fourth ink outlet tubes 26 and 38 to 40 are defined as fixed portions KT of the liquid supply tubes. In the present embodiment, the deforming movable portions HK (the first to the fourth ink supply tubes 60 to 63) are partitioned from the fixed portions KT (the first ink outlet tube 26) by the partitioning portion 55.

One end side of a flexible flat cable (FFC) 64 is connected to the substrate 57, and the other end side of the FFC 64 is connected to the liquid ejecting head 50 in a state of being supported by the carriage 46. The FFC 64 is an example of a flexible cable for supplying power to the liquid ejecting head 50, transmitting and receiving various signals to and from the liquid ejecting head 50 side and the like.

In other words, the FFC 64 extends from the substrate 57 to the partitioning portion 55, bending so as to bulge upward, continues to extend along the surface of the first region A side of the partitioning portion 55 to the second ink storage portion 21 side, subsequently wraps around the end portion of the second ink storage portion 21 side of the partitioning portion 55, and extends to the first ink storage portion 20 side along the surface of the second region B side of the partitioning portion 55.

Subsequently, the FFC 64 extends along the inside (the second ink storage portion 21 side) of the first to the fourth ink supply tubes 60 to 63, which bend from the surface of the second region B side of the partitioning portion 55, bending so as to bulge to the first ink storage portion 20 side in the same manner as the first to the fourth ink supply tubes 60 to 63. The FFC 64 subsequently extends to the liquid ejecting head 50, which is supported by the carriage 46.

Therefore, the first to the fourth ink supply tubes 60 to 63 and the FFC 64 bend toward the partitioning portion 55 from the liquid ejecting head 50. The majority of the first to the fourth ink supply tubes 60 to 63 and the FFC 64 is disposed in the second region B.

A ferrite core 65 is attached to the FFC 64 at a position part way down the FFC 64. The ferrite core 65 reduces the electromagnetic wave noise of the FFC 64, and is disposed between the end portion of the second ink storage portion 21 side in the surface of the first region A side of the partitioning portion 55 and the substrate disposition portion 56. In this case, the ferrite core 65 is in contact with the end portion of the second ink storage portion 21 side in the surface of the first region A side of the partitioning portion 55.

As illustrated in FIGS. 2 and 3, the first ink outlet tube 26 which is inserted into the housing 14 from the through hole 28 in the housing 14 extends toward the tube connecting portion 58 along the surface of the first region A side of the partitioning portion 55 to connect to the first ink supply needle 58*a*. In other words, the first ink outlet tube 26 is disposed to pass between the partitioning portion 55 and the substrate disposition portion 56 in the first region A.

Figure 4:
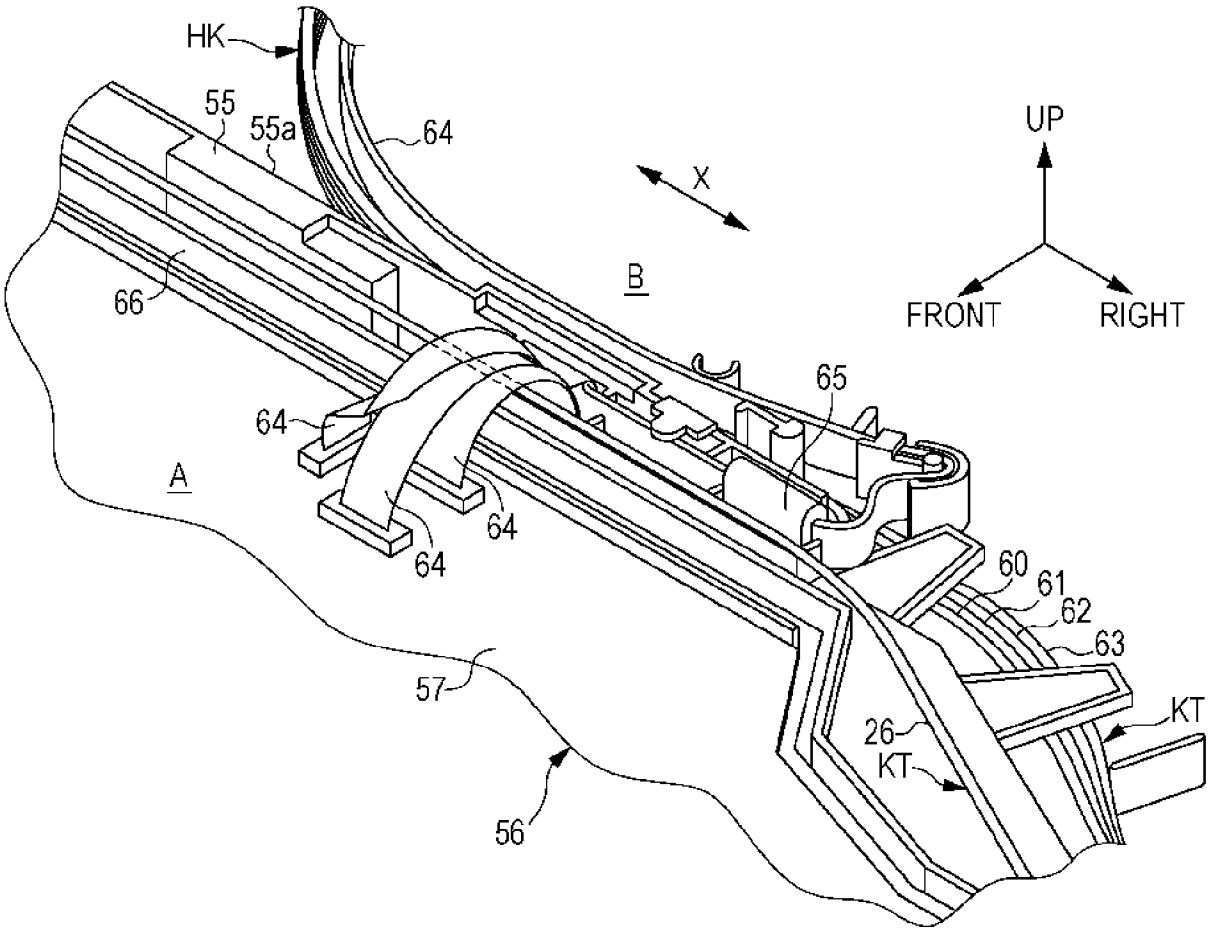
FIG. 4 is an enlarged schematic perspective view of the main components of FIG. 3.

In this case, as illustrated in FIG. 4, the first ink outlet tube 26 passes under an arched portion of the FFC 64 in the proximity of the substrate 57 and extends so as to make contact with the surface of the first region A side of the ferrite core 65. In this case, it is not necessary for the first ink outlet tube 26 to contact the ferrite core 65. Therefore, the ferrite core 65 also functions as the movement restriction member which restricts the first ink outlet tube 26 (the fixed portion KT) from moving to the second region B (the deforming movable portion HK) side.

As illustrated in FIGS. 3 and 4, a movement restriction wall 66 which restricts the first ink outlet tube 26 from moving to the substrate disposition portion 56 side is provided between the first ink outlet tube 26 and the substrate disposition portion 56 in the housing 14 so as to extend along the partitioning portion 55. Therefore, the first ink outlet tube 26, which is one of the first to the fourth ink outlet tubes 26 and 38 to 40, is disposed in the housing 14 so as to pass between the partitioning portion 55 and the movement restriction wall 66.

As illustrated in FIG. 2, a plate-shaped cover member 67 is disposed in the housing 14 to cover the entire first region A. In other words, the cover member 67 is disposed in the housing 14 so as to cover a region (the region indicated using a double-dot-dash line in FIG. 2) including the partitioning portion 55, the first to the fourth ink outlet tubes 26 and 38 to 40 (the fixed portions KT), the substrate disposition portion 56, and the tube connecting portion 58.

Next, description will be given of the effects of the multi-function printer 11.

When performing the printing using the multi-function printer 11; first, a document is placed on the scanner 13, and subsequently, the operation unit 15 is operated to start the printing operation. This causes the document to be read by the scanner 13. Next, based on the data of the document which is read, the paper P is selectively fed from the feed cassette 18 or 19 onto the support stand 51, and the printing is carried out by ejecting the colored inks from the nozzles (not shown) of the liquid ejecting head 50, which moves reciprocally in the main scanning direction X together with the carriage 46, onto the paper P.

Since the carriage 46 moves reciprocally in the main scanning direction X during the printing of the paper P, the first to the fourth ink supply tubes 60 to 63 and the FFC 64 also move reciprocally in the main scanning direction X to track the carriage 46. Therefore, when the partitioning portion 55 is not present, there is a concern that the first ink outlet tube 26 which is routed within the housing 14 will interfere with the internal components of the housing 14 (in particular, those which move during the printing of the paper P) such as the first to the fourth ink supply tubes 60 to 63, the FFC 64, and the carriage 46.

In the present embodiment, this is addressed within the housing 14 by the first region A, in which the first ink outlet tube 26 (the fixed portion KT) is disposed, being partitioned from the second region B, in which the internal components of the housing 14 such as the first to the fourth ink supply tubes 60 to 63 (the deforming movable portion HK), the FFC 64, and the carriage 46 are disposed, by the partitioning portion 55. Therefore, interference between the first ink outlet tube 26 and the internal components and the like of the housing 14 such as the first to the fourth ink supply tubes 60 to 63, the FFC 64, and the carriage 46 is suppressed.

According to the embodiment which is described above in detail, it is possible to obtain the following effects.

(1) The first to the fourth ink supply tubes 60 to 63 and the FFC 64 are disposed along the surface of the second region B side of the partitioning portion 55, and the first ink outlet tube 26 is disposed along the surface of the first region A side of the partitioning portion 55. Therefore, since the first ink outlet tube 26 is partitioned from the first to the fourth ink outlet tubes 60 to 63 and the FFC 64 by the partitioning portion 55, it is possible to suppress the interference between the first ink outlet tube 26 (the fixed portion KT) and the first to the fourth ink outlet tubes 60 to 63 (the deforming movable portion HK) and the FFC 64. In other words, it is possible to suppress the interference of the deforming movable portions HK which are routed inside the housing 14 and which deform to track the reciprocal movement of the liquid ejecting head 50 (the carriage 46) with the internal components (the fixed portions KT and the like) of the opposite side from the deforming movable portions HK in the housing 14, the partitioning portion 55 being interposed between the deforming movable portion HK and the internal components.

(2) The first to the fourth ink supply tubes 60 to 63 and the FFC 64 bend toward the partitioning portion 55 from the liquid ejecting head 50 which is supported by the carriage 46. Therefore, even when the liquid ejecting head 50 moves reciprocally in the main scanning direction X together with the carriage 46, it is possible to stabilize the bending state of the first to the fourth ink supply tubes 60 to 63 and the FFC 64.

(3) The liquid supply tube is formed of the first to the fourth ink supply tubes 60 to 63 and the first to the fourth ink outlet tubes 26 and 38 to 40, and the first to the fourth ink supply tubes 60 to 63 and the first to the fourth ink outlet tubes 26 and 38 to 40 are connected to each other via the tube connecting portion 58 (the first to the fourth ink supply needles 58*a* to 58*d*). Therefore, it is easy to perform the assembly work of the first to the fourth ink supply tubes 60 to 63 and the first to the fourth ink outlet tubes 26 and 38 to 40.

(4) The substrate disposition portion 56 on which the substrate 57 is disposed is provided in the first region A in the housing 14, and the first ink outlet tube 26 (the fixed portion KT) is disposed so as to pass between the partitioning portion 55 and the substrate disposition portion 56. Therefore, when there is little space between the partitioning portion 55 and the substrate disposition portion 56, it is possible to make effective use of the little space by passing the first ink outlet tube 26 (the fixed portion KT) through the space.

(5) the movement restriction member which restricts the first ink outlet tube 26 (the fixed portion KT) from moving to the second region B side (the deforming movable portion HK side) is disposed between the partitioning portion 55 and the substrate disposition portion 56, and the movement restriction member is configured by the ferrite core 65 which reduces the electromagnetic wave noise of the FFC 64. Therefore, it is possible to cause the ferrite core 64 which reduces the electromagnetic wave noise of the FFC 65 to also function as the movement restriction member which restricts the first ink outlet tube 26 from moving to the second region B side; thus, it is possible to reduce the number of components in comparison with a case in which a movement restriction member is disposed in the housing 14 separately from the ferrite core 65.

(6) The FFC 64 is connected to the substrate 57, and the first ink outlet tube 26 (the fixed portion KT) is disposed to pass under the FFC 64. Therefore, it is possible to restrict the movement of the first ink outlet tube 26 in the height direction (upward) using the FFC 64.

(7) The movement restriction wall 66 which restricts the first ink outlet tube 26 from moving to the substrate disposition portion 56 side is provided between the first ink outlet tube 26 (the fixed portion KT) and the substrate disposition portion 56. Therefore, it is possible to restrict the movement of the first ink outlet tube 26 to the substrate disposition portion 56 side using the movement restriction wall 66; thus, it is possible to suppress the interference between the first ink outlet tube 26 and the substrate 57.

(8) The first ink outlet tube 26 (the fixed portion KT), which is one of the first to the fourth ink outlet tubes 26 and 38 to 40 (the plurality of fixed portions KT), is disposed in the housing 14 so as to pass between the partitioning portion 55 and the substrate disposition portion 56. Therefore, when there is little space between the partitioning portion 55 and the substrate disposition portion 56, it is possible to make effective use of the little space by passing the first ink outlet tube 26 through the space.

(9) The cover member 67 which covers the entire first region A including the first ink outlet tube 26 (the fixed portion KT) is disposed in the housing 14. Therefore, since it is possible to hide the entire first region A including the first ink outlet tube 26 using the cover member 67, it is possible to improve the external appearance.

Modification Example

The embodiment described above can also be modified as described below.

Figure 5:
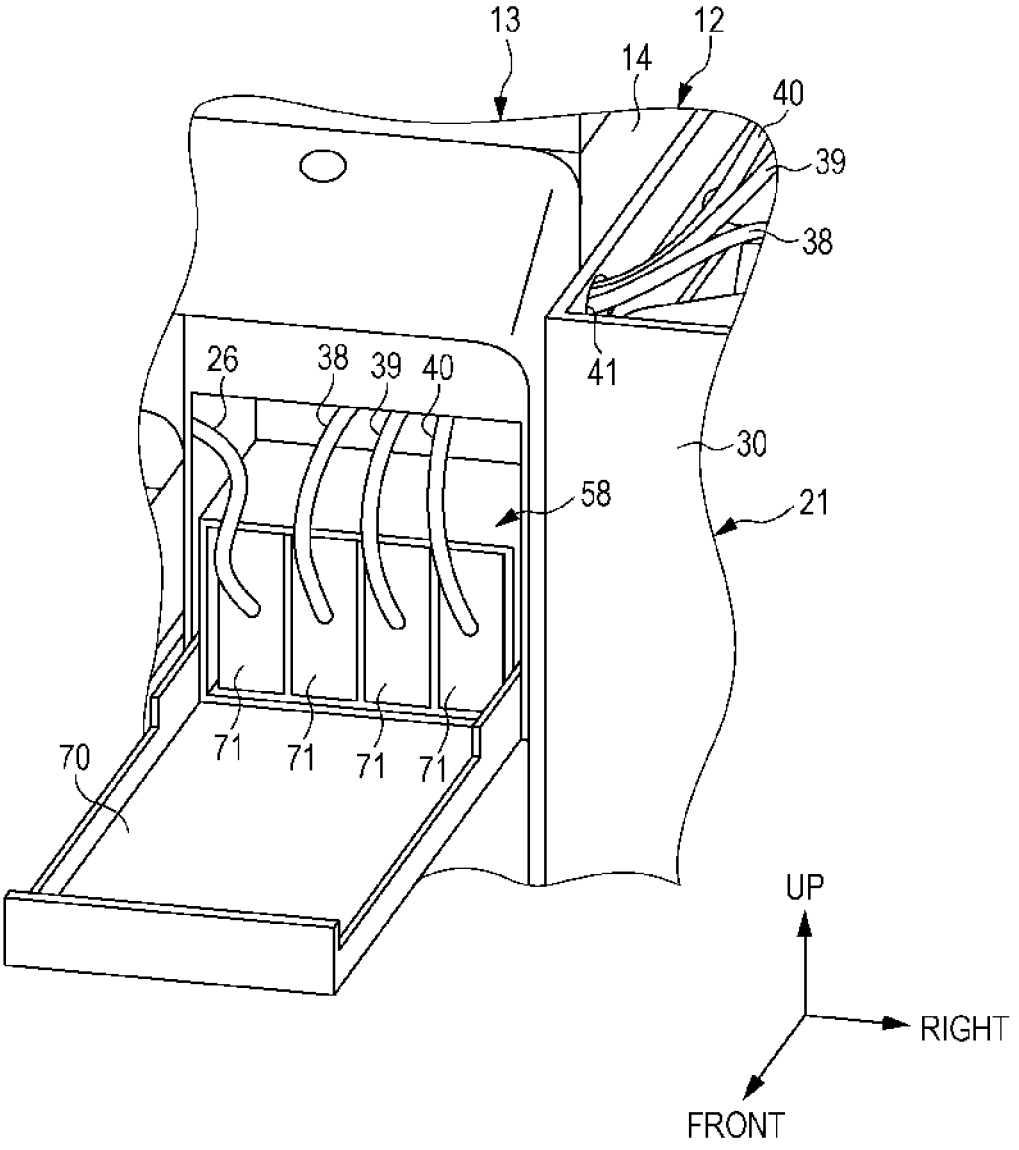
FIG. 5 is an enlarged schematic perspective view of the main components of a multi-function printer of a modification example.
Figure 6:
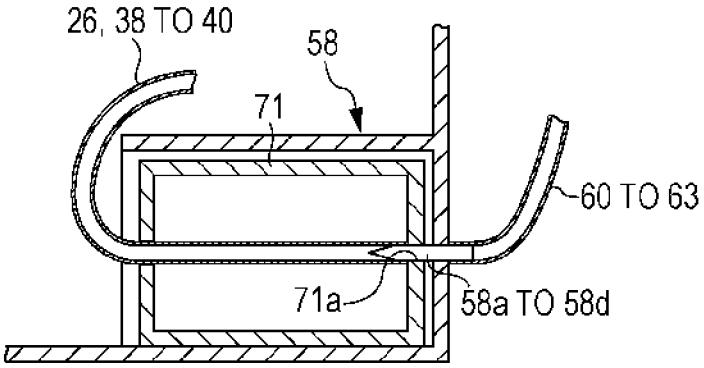
FIG. 6 is a cross-sectional schematic view illustrating the main components of FIG. 5 from the side.

As illustrated in FIGS. 5 and 6, a cap 70 is provided on the end portion of the second ink storage body 21 side on the front surface of the housing 14. The cap 70 can be freely opened and closed and is capable of exposing the tube connecting portion 58. Adapters 71 may be attached to the end portions of the first to the fourth ink outlet tubes 26 and 38 to 40 on the side which is connected to the tube connecting portion 58. The adapters 71 are an example of the cuboid vacant connecting portion which is capable of connecting to the first to the fourth ink supply needles 58*a* to 58*d*. In this case, communicating holes 71*a* which communicate with the first to the fourth ink outlet tubes 26 and 38 to 40 are formed in the opposing surface of each of the first to the fourth ink supply needles 58*a* to 58*d* in the adapters 71 which are attached to each of the first to the fourth ink outlet tubes 26 and 38 to 40. By adopting such a configuration, it is possible to easily connect the first to the fourth ink outlet tubes 26 and 38 to 40 to the first to the fourth ink supply needles 58*a* to 58*d* through each of the communicating holes 71*a* of the adapters 71 simply by opening the cap 70 and mounting the adapters 71 which are attached to the first to the fourth ink outlet tubes 26 and 38 to 40 to the tube connecting portion 58.

Figure 7:
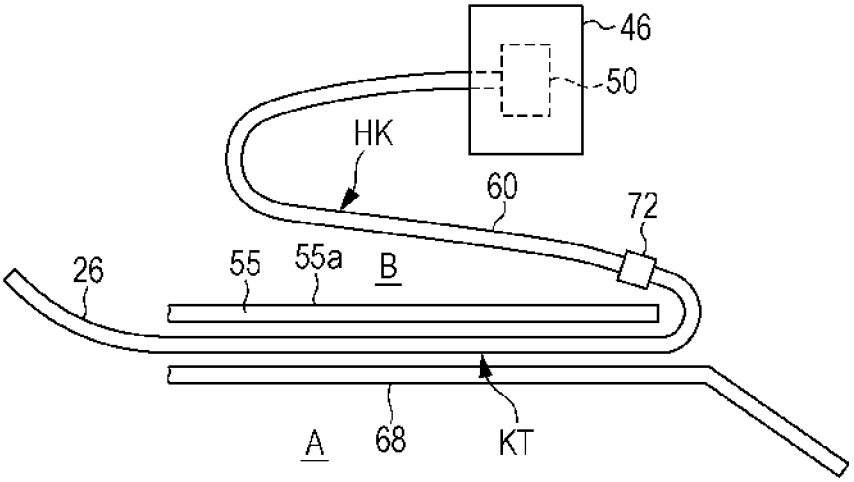
FIG. 7 is a schematic plan view illustrating a routing state of a first ink outlet tube and a first ink supply tube of the modification example.

As illustrated in FIG. 7, the first ink outlet tube 26 may be directly connected to the first ink supply tube 60 using a joining member 72, which is an example of the cylindrical connecting portion, and be folded back to interpose the partitioning portion 55. By adopting such a configuration, it is possible to reduce the length of the first ink outlet tube 26. Alternatively, the first ink outlet tube 26 and the first ink supply tube 60 may be formed integrally such that both components are formed of one tube.

The second to the fourth ink outlet tubes 38 to 40 and the second to the fourth ink supply tubes 61 to 63 may be directly connected by respective joining members 72.

Figure 8:
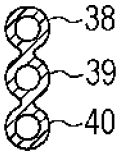
FIG. 8 is a cross-sectional schematic view of second to fourth ink outlet tubes of the modification example.

As illustrated in FIG. 8, the second to the fourth ink outlet tubes 38 to 40 (the fixed portions KT) may be formed integrally in a lined-up state. In other words, the second to the fourth ink outlet tubes 38 to 40 may be configured of a so-called multiple tube. By adopting such a configuration, the second to the fourth ink outlet tubes 38 to 40 do not separate from each other; thus, it is possible to easily handle the second to the fourth ink outlet tubes 38 to 40. In particular, by configuring the second to the fourth ink outlet tubes 38 to 40 with a multiple tube when the positions of the first ink storage portion 20 and the second ink storage portion 21 are exchanged, it is possible to easily handle the second to the fourth ink outlet tubes 38 to 40 when passing the second to the fourth ink outlet tubes 38 to 40 between the partitioning portion 55 and the movement restriction wall 66. When the movement restriction wall 66 is not present, it is possible to easily handle the second to the fourth ink outlet tubes 38 to 40 when passing the second to the fourth ink outlet tubes 38 to 40 between the partitioning portion 55 and the substrate disposition portion 56.

As illustrated in FIG. 2, within the housing 14, the cover member 67 may be configured to completely cover a region (the region indicated using a dot-and-dash line in FIG. 2) including the ink supply tubes 60 to 63 and the FFC 64 in addition to a region (the region indicated using a double-dot-dash line in FIG. 2) including the partitioning portion 55, the first to the fourth ink outlet tubes 26 and 38 to 40, the substrate disposition portion 56, and the tube connecting portion 58. If such a configuration is adopted, it is possible to improve the external appearance, and it is possible to suppress the occurrence of a user touching the ink outlet tubes 26 and 38 to 40 and the ink supply tubes 60 to 63.

Figure 9A:
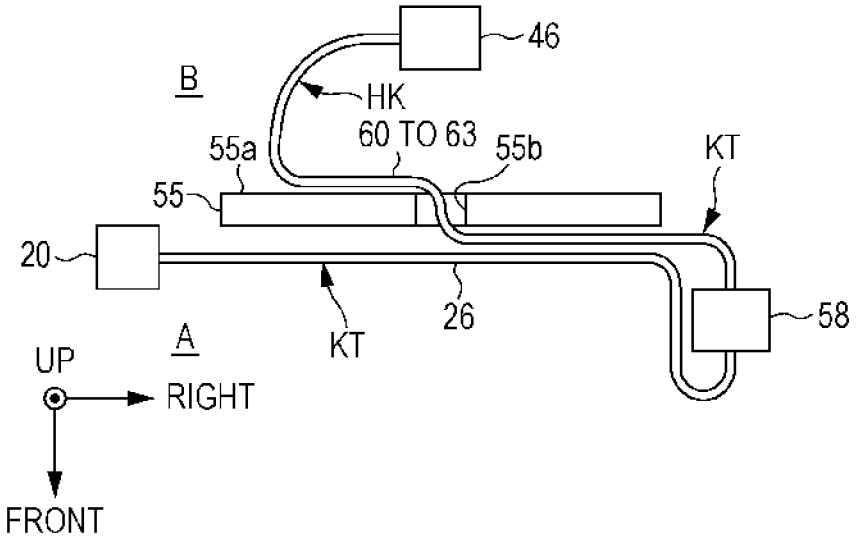
FIGS. 9A and 9B are schematic plan views illustrating a routing state of the first ink outlet tube and the first to fourth ink supply tubes of the modification example.

As illustrated in FIG. 9A, a configuration may be adopted in which a concave portion 55*b* is formed in the center portion of the partitioning portion 55, and the first to the fourth ink supply tubes 60 to 63 are routed so as to pass through the concave portion 55*b*. By adopting such a configuration, it is possible to ensure that the movement of the portions of the first to the fourth ink supply tubes 60 to 63 which can move by deformation (tracking deformation) is not transmitted to the portions of the first to the fourth ink supply tubes 60 to 63 which cannot move by deformation.

Figure 9B:
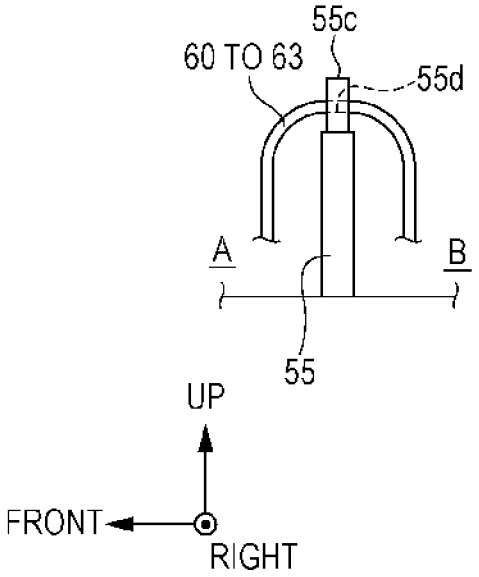

The first to the fourth ink supply tubes 60 to 63 should surmount the partitioning portion 55, and it is not necessary to form the concave portion 55*b* in the partitioning portion 55. FIG. 9B is a view showing the portion at which the first to the fourth ink supply tubes 60 to 63 surmount the partitioning portion 55 as seen from the main scanning direction X. As illustrated in FIG. 9B, a configuration may be adopted in which a cylindrical fixing member 55*c* is provided on the top portion of the partitioning portion 55, the fixing member 55*c* including a through hole 55*d* with an inner diameter of approximately the same size as the outer diameter of the first to the fourth ink supply tubes 60 to 63, and the first to the fourth ink supply tubes 60 to 63 pass through the through hole 55*d*.

By adopting such a configuration, it is possible to ensure that the movement of the portions of the first to the fourth ink supply tubes 60 to 63 which can move by deformation (tracking deformation) is not transmitted to the portions of the first to the fourth ink supply tubes 60 to 63 which cannot move by deformation.

In regard to the range in which the first to the fourth ink supply tubes 60 to 63 can move by deformation (tracking deformation), the range being the target of contact prevention in the invention, in the embodiment described with reference to FIG. 9A, the target is a range from the position at which the ink supply tube passes through the concave portion 55*b* to the position at which the ink supply tube is fixed to the carriage 46, and in the embodiment described with reference to FIG. 9B, the target is a range from the position at which the ink supply tube is fixed by the fixing member 55*c* to the position at which the ink supply tube is fixed to the carriage 46.

In the first region A, the first ink outlet tube 26 and the first to the fourth ink supply tubes 60 to 63 may be bound together using a bounding band or the like.

Figure 10:
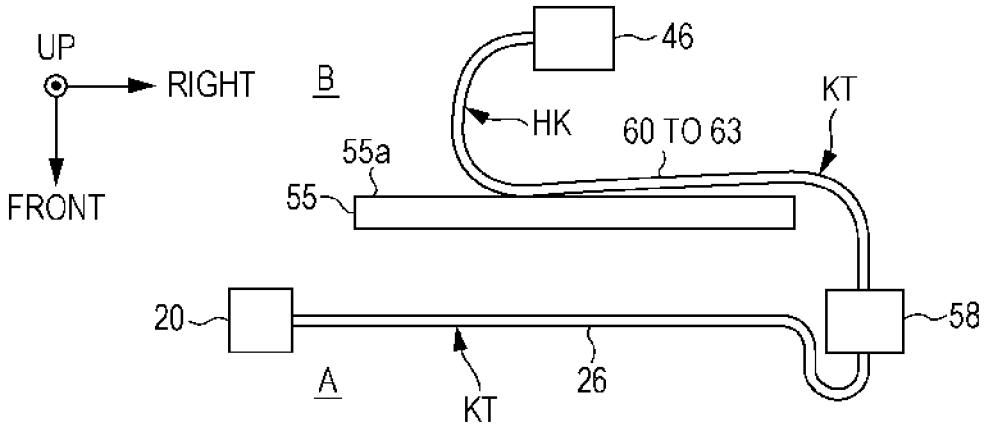
FIG. 10 is a schematic plan view illustrating a routing state of the first ink outlet tube and the first to fourth ink supply tubes of the modification example.

As illustrated in FIG. 10, it is not necessary to dispose the fixed portions KT along the partitioning portion 55. In other words, the fixed portions KT may be disposed separated from the partitioning portion 55. In this case, the fixed portions KT of the first to the fourth ink supply tubes 60 to 63 are arranged vertically to line up in the vertical direction so as to run along the partitioning portion 55; however, the fixed portions KT may be arranged horizontally to line up in the horizontal direction perpendicular to the partitioning portion 55.

Figure 11:
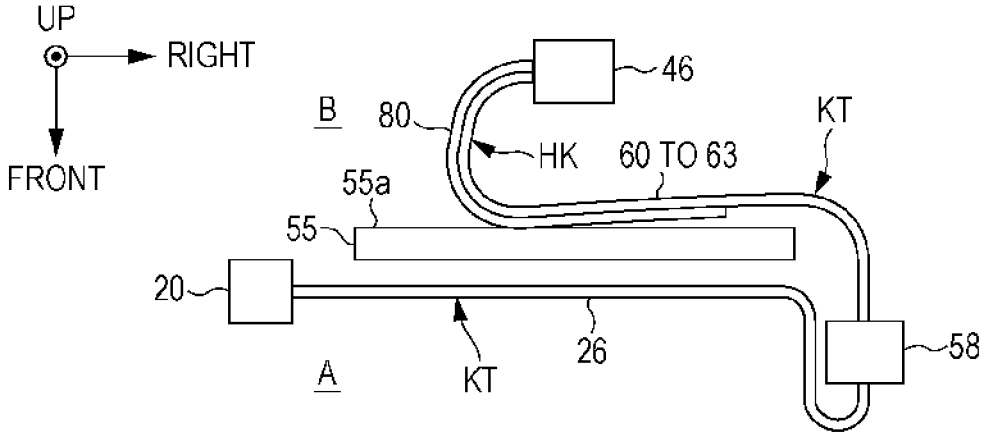
FIG. 11 is a schematic plan view illustrating a routing state of the first ink outlet tube and the first to fourth ink supply tubes of the modification example.

As illustrated in FIG. 11, a configuration may be adopted in which a belt shaped flexible protective member 80 is attached to the outside of the deforming movable portions HK of the first to the fourth ink supply tubes 60 to 63, and the deforming movable portions HK are protected by the protective member 80. By adopting such a configuration, when the protective member 80 deforms to track the reciprocal movement of the liquid ejecting head 50 (the carriage 46), the bearing portion 55*a* of the partitioning portion 55 bears the protective member 80. In this case, the protective member 80 and the first ink outlet tube 26 (the fixed portion KT) are partitioned by the partitioning portion 55.

A configuration may be adopted in which a rib, bonded onto which is a film, is formed on at least one of the sides of the partitioning portion 55, and the first ink outlet tube 26 (the fixed portion KT) is indirectly partitioned from the first to the fourth ink supply tubes 60 to 63 (the deforming movable portions HK) by the partitioning portion 55.

A configuration may be adopted in which the FFC 64 passes the outside of the first to the fourth ink supply tubes 60 to 63, and when the FFC 64 deforms to track the reciprocal movement of the liquid ejecting head 50 (the carriage 46), the bearing portion 55*a* of the partitioning portion 55 bears the FFC 64. In this case, the FFC 64 is partitioned from the deforming movable portions HK (the first to the fourth ink supply tubes 60 to 63) by the partitioning portion 55.

The cover member 67 may be omitted.

As long as the first ink outlet tube 26 is disposed in the first region A, it is not necessary to dispose the first ink outlet tube 26 to pass between the partitioning portion 55 and the movement restriction wall 66.

The movement restriction wall 66 may be omitted. In this case, the first ink outlet tube 26 is disposed to pass between the partitioning portion 55 and the substrate disposition portion 56 in the housing 14.

It is not necessary to dispose the first ink outlet tube 26 to pass under the FFC 64.

The ferrite core 65 may be omitted.

The movement restriction member may be configured by a member other than the ferrite core 65, and the movement restriction member itself may be omitted.

As long as the first ink outlet tube 26 is disposed in the first region A, it is not necessary to dispose the first ink outlet tube 26 to pass between the partitioning portion 55 and the substrate disposition portion 56.

It is not necessary to dispose the first to the fourth ink supply tubes 60 to 63 and the FFC 64 so as to bend toward the partitioning portion 55 from the liquid ejecting head 50 which is supported by the carriage 46.

The partitioning portion 55 is not limited to a wall-shaped member, and may be configured by lining up a plurality of column shaped members. In this case, the plurality of column shaped members may be provided with or without an interval therebetween.

The second ink storage portion 21 may be omitted.

A configuration may be adopted in which the first ink storage portion 20 is omitted, and the first ink storage body 23 is disposed in the second case 30 of the second ink storage portion 21. In other words, the liquid storage portion may be disposed on only one side of the housing 14. By adopting such a configuration, the distance from the first ink storage body 23 to the tube connecting portion 58 is reduced; thus, it is possible to increase the length of the first ink outlet tube 26.

At least one of the first ink storage portion 20 and the second ink storage portion 21 may be configured of a rigid case in which the ink is stored directly.

At least one of the first ink storage portion 20 and the second ink storage portion 21 may be configured to be refillable.

The disposition of the first ink storage portion 20 and the second ink storage portion 21 may be exchanged.

The ink outlet tubes 26 and 38 to 40 may intersect each other.

A configuration may be adopted in which at least one of three inks other than one of the black ink, the cyan ink, the magenta ink, and the yellow ink is supplied from an ink cartridge.

The ink jet printer 12 is configured to support the four colors of black ink, cyan ink, magenta ink, and yellow ink; however, a configuration which supports monochrome or two-colors may be adopted, and a configuration which supports five or more colors may be adopted.

The order in the main scanning direction X in which the first to the fourth ink supply needles 58*a* to 58*d* are lined up may be arbitrarily changed.

The recording medium may be, not only the paper P, but also a fabric, a plastic film, a CD or the like.

Figure 12:
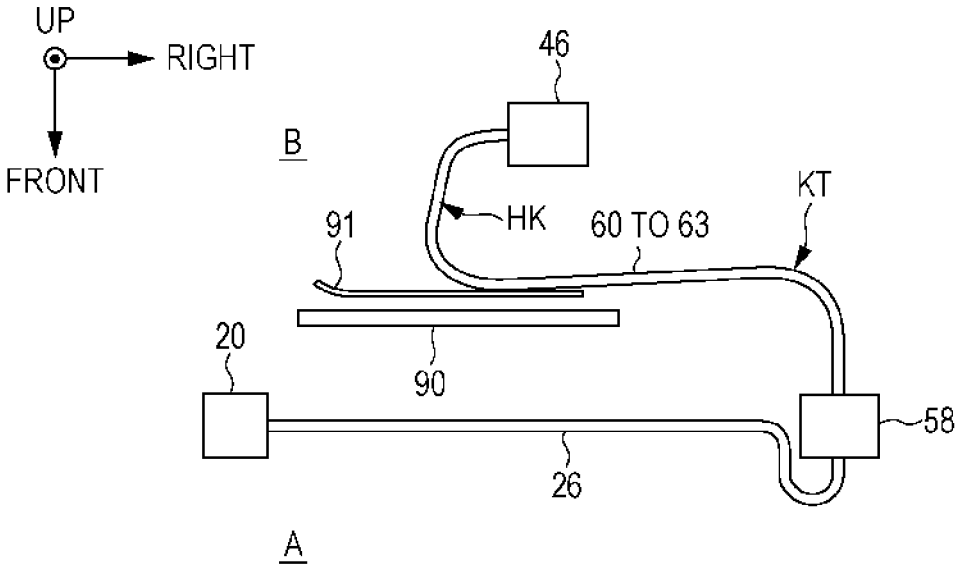
FIG. 12 is a schematic plan view illustrating a routing state of the first ink outlet tube and the first to fourth ink supply tubes of the modification example.

In the present embodiment, the bearing portion 55*a* is configured to also function as the partitioning portion 55; however, as illustrated in FIG. 12, a bearing portion 91 and a partitioning portion 90 may be configured separately.

Second Embodiment

Figure 13:
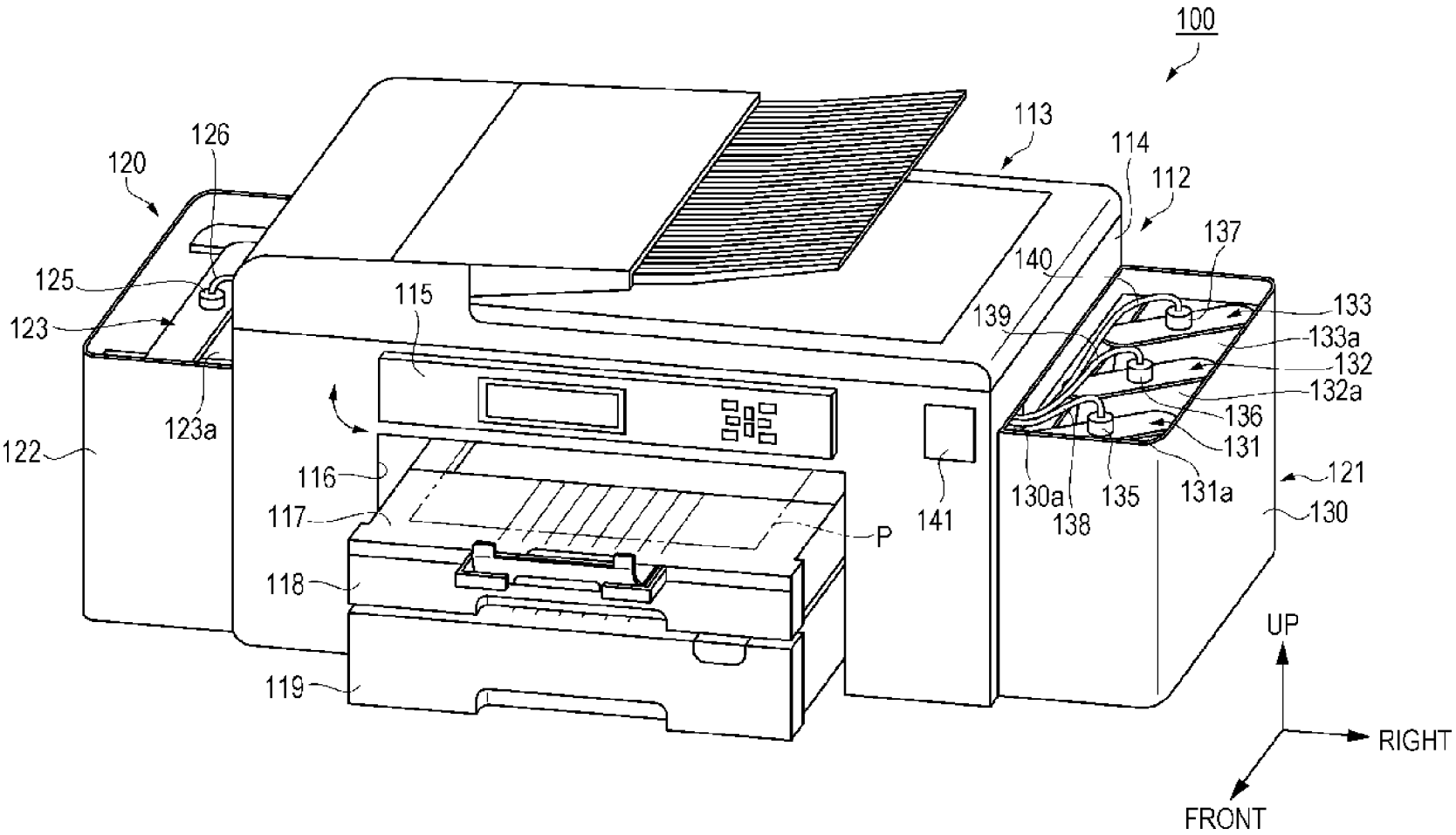
FIG. 13 is a perspective view of an exterior of a multi-function printer according to a second embodiment.

In the second embodiment, description will be given of an ink jet printer in which the substrate disposition portion is provided above the portions of the first to the fourth ink supply tubes 60 to 63 which are not subjected to tracking deformation. FIG. 13 is a perspective view of the exterior of a multi-function printer 100 as seen from the front according to the present embodiment.

The multi-function printer 100 has an overall substantially cuboid shape and is provided with an ink jet printer 112, which is an example of the recording apparatus that performs printing (recording) by ejecting ink which is an example of the liquid onto the paper P which is an example of the recording medium, and a scanner 113 which is disposed on the ink jet printer 112 and reads documents and the like. The ink jet printer 112 is provided with a cuboid housing 114.

An operation panel 115 is provided on the top end portion of the front end portion of the housing 114 as the operation unit for performing the various operations of the multi-function printer 100. The operation panel 115 has a rotating fulcrum on the upper side thereof, and is provided to be capable of rotating in the direction of the arrows.

In the upper portion of the front surface of the housing 114, a rectangular output port 116 from which the paper P, which is printed on within the housing 114, is output is open. A rectangular output tray 117 which supports the paper P which is output from the output port 116 extends from the output port 116 to protrude toward the front. Upper and lower level feed cassettes 118 and 119 are detachably mounted to the bottom side of the output tray 117 in the front surface of the housing 114. Different sizes of the paper P are stored in a stacked state in each of the feed cassettes 118 and 119. Naturally, the same sizes of the paper P may be stored in a stacked state in each of the feed cassettes 118 and 119.

A first ink storage portion 120 which is an example of the liquid storage portion is attached to the left side which is one side of the housing 114, and a second ink storage portion 121 which is an example of the liquid storage portion is attached to the right side which is the other side of the housing 114. In other words, the first ink storage portion 120 and the second ink storage portion 121 are disposed on the outside of the housing 114.

Figure 14:
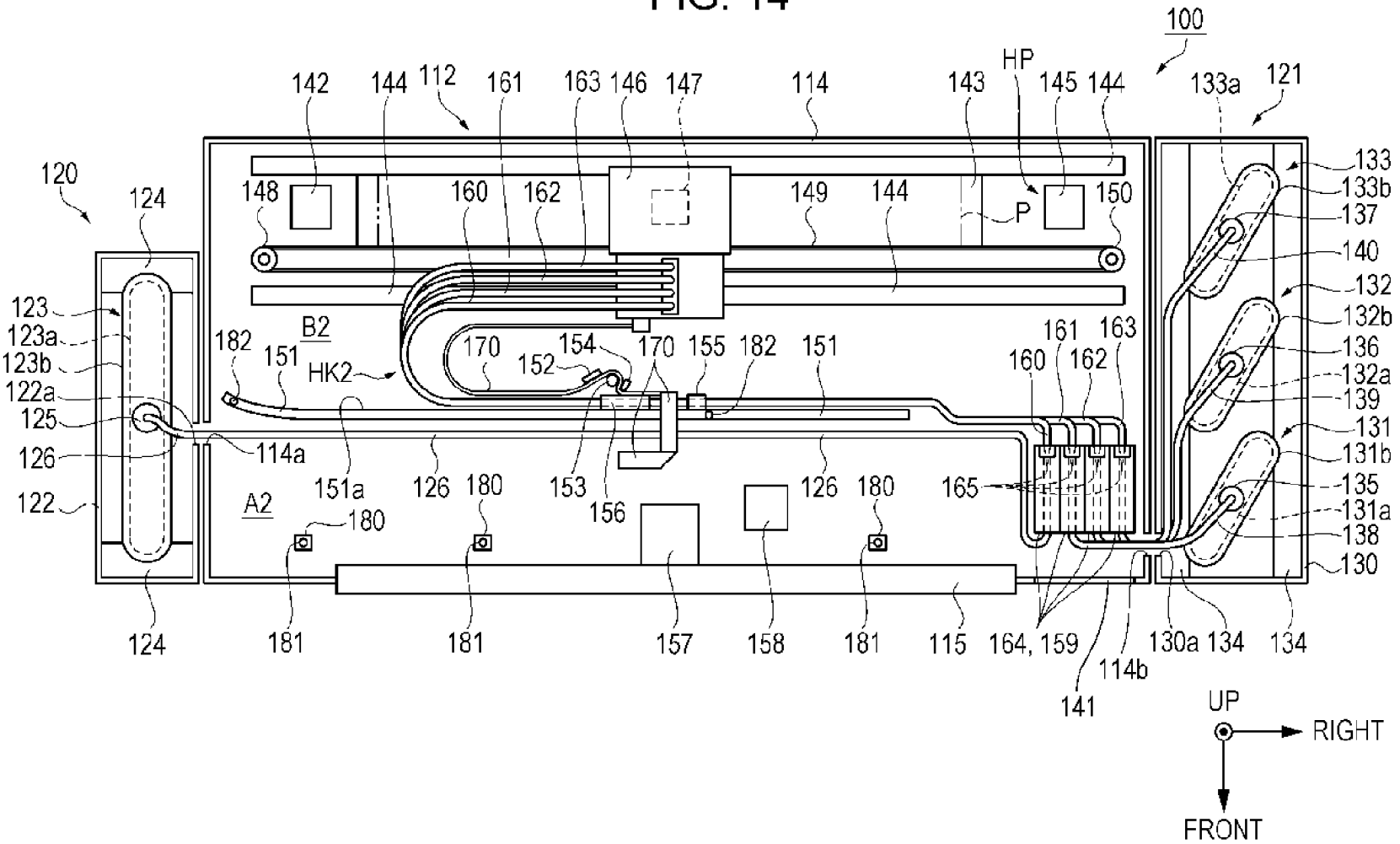
FIG. 14 is a cross-sectional schematic plan view illustrating the inside of an ink jet printer according to the second embodiment.

FIG. 14 is a cross-sectional schematic plan view illustrating the inside of the ink jet printer 112. The first ink storage portion 120 is provided with a first case 122 and a first ink storage body 123. The first case 122 has the shape of a box which is open at the top end, has a bottom, and has a rectangular shape that is long in the front-rear direction. The first ink storage body 123 is housed in the first case 122. Flange portions 124 are provided on both end portions in the longitudinal direction of the top end portion within the first case 122.

The first ink storage body 123 includes a first ink pouch 123*a* which is filled with black ink, and a first supporting plate 123*b* which is attached to the top end portion of the first ink pouch 123*a*. The first ink storage body 123 is housed in the first case 122 in a state in which each end portion in the longitudinal direction of the first supporting plate 123*b* is mounted on each of the flange portions 124 of the first case 122. In other words, the first ink storage body 123 is housed in the first case 122 such that the first ink pouch 123*a* is hung from the first supporting plate 123*b* in the first case 122.

A first ink outlet portion 125 for allowing the black ink within the first ink pouch 123*a* to flow out is provided on the center portion of the top surface of the first supporting plate 123*b*. One end side of a first ink outlet tube 126 is connected to the first ink outlet portion 125, the other end side of the first ink outlet tube 126 passes through a through hole 122*a* which is formed in the side wall of the first case 122 on the housing 114 side, through a through hole 114*a* which is formed in the side wall of the housing 114 on the first case 122 side, and is inserted into the housing 114.

The second ink storage portion 121 is provided with a second case 130 and second to fourth ink storage bodies 131 to 133. The second case 130 has the shape of a box which is open at the top end, has a bottom, and has a rectangular shape that is long in the front-rear direction. The second to the fourth ink storage bodies 131 to 133 are housed in the second case 130 so as to line up in the front-rear direction. Flange portions 134 are provided on both end portions in the short direction of the top end portion within the second case 130 to extend across the entire longitudinal direction. The second to the fourth ink storage bodies 131 to 133 are set to be smaller than the first ink storage body 123.

The second to the fourth ink storage bodies 131 to 133 are respectively provided with second to fourth ink pouches 131*a* to 133*a*, and second to fourth supporting plates 131*b* to 133*b* which are attached to the top end portions of the second to the fourth ink pouches 131*a* to 133*a*. The second ink pouch 131*a*, the third ink pouch 132*a*, and the fourth ink pouch 133*a* are filled with a cyan ink, a magenta ink, and a yellow ink, respectively. Therefore, the inks which are stored in the second to the fourth ink storage bodies 131 to 133 of the second ink storage portion 121 are different colors (types) from the ink which is stored in the first ink storage body 123 of the first ink storage portion 120.

The second to the fourth ink storage bodies 131 to 133 are housed in the second case 130 in a state in which each end portion in the longitudinal direction of the second to the fourth supporting plates 131*b* to 133*b* is mounted on each of the flange portions 134 of the second case 130. In other words, the second to the fourth ink storage bodies 131 to 133 are housed in the second case 130 such that the second to the fourth ink pouches 131*a* to 133*a* are hung from the second to the fourth supporting plates 131*b* to 133*b* in the second case 130.

The second to the fourth ink storage bodies 131 to 133 are stored in the second case 130 so as to line up from the from side toward the rear side in order of the second ink storage body 131, the third ink storage body 132, and the fourth ink storage body 133. Second to fourth ink outlet portions 135 to 137 for allowing the inks within the second to the fourth ink pouches 131*a* to 133*a* to flow out are provided on the center portions of the top surfaces of the second to the fourth supporting plates 131*b* to 133*b*.

One end side of each of second to fourth ink outlet tubes 138 to 140 is connected to the second to the fourth ink outlet portions 135 to 137, respectively. Meanwhile, the other end sides of the second to the fourth ink outlet tubes 138 to 140 pass through a through hole 130*a* which is formed in the side wall of the second case 130 on the housing 114 side, through a through hole 114*b* which is formed in the side wall of the housing 114 on the second case 130 side, and is inserted into the housing 114.

A pair of guide rails 144 is provided on the rear portion inside the housing 114, each guide rail 144 to the front or the rear of the other, so as to extend in the left-right direction. Above the pair of guide rails 144, a carriage 146 is disposed so as to bridge over the pair of guide rails 144. In other words, the carriage 146 is supported by the pair of guide rails 144 so as to be capable of moving reciprocally while being guided along the pair of guide rails 144.

A follower pulley 150 is provided on one end side in the left-right direction (the end portion of the second ink storage portion 121 side) of the guide rail 144 of the front side, of the pair of guide rails 144, and a drive pulley 148 which can be rotationally driven by a carriage motor (not shown) is provided on the other end side (the end portion of the first ink storage portion 120 side).

An endless timing belt 149 is wrapped around both the pulleys 148 and 150, and a portion of the timing belt 149 is joined to a portion of the carriage 146. Therefore, when the drive pulley 148 is rotationally driven by the driving of the carriage motor, the drive force is transmitted to the carriage 146 via the timing belt 149, and the carriage 146 moves reciprocally in the left-right direction (the main scanning direction).

A liquid ejecting head 147 is provided on the bottom end portion of the carriage 146 and is capable of ejecting each color of the ink which is supplied from the first ink storage portion 120 and the second ink storage portion 121. A support stand 143 is disposed in a position which opposes the liquid ejecting head 147 in the housing 114 and supports the paper which is selectively fed from the feed cassette 118 or 119 (refer to FIG. 13).

The printing onto the paper P is carried out by ejecting each color of ink onto the paper P on the support stand 143 from a plurality of nozzles (not shown) which are open on the lower surface of the liquid ejecting head 147 while the carriage 146 moves in the left-right direction.

One end portion in the left-right direction (the end portion of the second ink storage portion 121 side) in the movement region of the carriage 146 is set to a home position HP region in which the carriage 146 rests, and a cap 145 or the like for performing maintenance such as cleaning of the liquid ejecting head 147 is disposed in the home position HP region.

Meanwhile, a flushing box 142 is disposed at the other end portion in the left-right direction (the end portion of the opposite side from the home position HP) in the movement region of the carriage 146. The flushing box 142 is for receiving the flushed ink from a flushing operation in which ink is discharged in a context that is unrelated to the printing from the nozzles of the liquid ejecting head 147 during the printing of the paper P.

Figure 15:
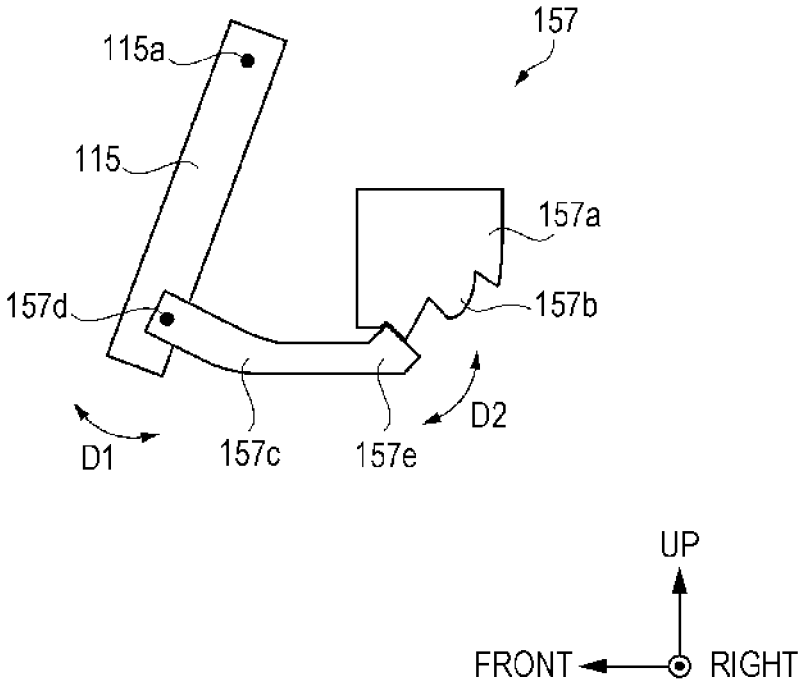
FIG. 15 is a diagram for illustrating the schematic configuration of an inclination mechanism.

An inclination mechanism 157 which defines the inclination angle of the operation panel 115 is provided in the center portion of the rear side of the operation panel 115. FIG. 15 is a diagram for illustrating the schematic configuration of the inclination mechanism 157. The operation panel 115 includes a rotating fulcrum 115*a* on the upper portion thereof, and is provided to be capable of rotating in the direction of arrows D1. The inclination mechanism 157 is configured to include a rotation member 157*c* and a fixed portion 157*a*. The rotation member 157*c* includes a rotating fulcrum 157*d*, is joined to the lower portion of the operation panel 115 and is capable of rotating in the direction of arrows D2, and the fixed portion 157*a* is fixed to the inside of the housing 114.

The rotation member 157*c* includes a protruding portion 157*e*, and the fixed portion 157*a* includes a plurality of engaging portions 157*b* which can engage with the protruding portion 157*e*. According to the rotational position of the operation panel 115, the protruding portion 157*e* can engage with one of the plurality of engaging portions 157*b*.

According to this configuration, the inclination mechanism 157 is provided with a function of maintaining the position of the inclination angle of the operation panel 115 when a user grips the lower end portion of the operation panel 115, and rotates the operation panel 115 to cause the protruding portion 157*e* to engage with one of the plurality of engaging portions 157*b*. In other words, the user can select the inclination angle of the operation panel 115 by operating the inclination mechanism 157. A buzzer unit 158 which generates an alert sound or the like is provided on the rear side of the operation panel 115.

A tube connecting portion 159 which if configured from four adapters 164 is provided on the second ink storage body 121 side on the front side of the inside of the housing 114 of FIG. 14. In the same manner as the adapters 71 which are provided on the rear surface side of the cap 70 of FIG. 5 described in the first embodiment, when a cap 141 which is provided on the front surface side of FIG. 13 is rotated and opened, the square box-shaped adapters 164 are exposed.

One end of the first ink outlet tube 126 is connected to the first ink outlet portion 125 of the first ink storage portion 123 of FIG. 14, and the other end is connected to the adapter 164. Similarly, one end of the second to the fourth ink outlet tubes 138 to 140 is connected to the second to the fourth ink outlet portions 135 to 137 of the second to the fourth ink storage bodies 131 to 133, and the other end is connected to the adapter 164.

The first ink outlet tube 126 is connected to the first ink supply tube 160 via an ink supply needle 165 provided in the adapter 164. Similarly, the second to the fourth ink outlet tubes 138 to 140 are connected to the second to the fourth ink supply tubes 161 to 163 via the ink supply needles 165 provided in the adapters 164.

The first ink storage body 123 is connected to the liquid ejecting head 147 via the first ink outlet tube 126, the adapter 164, and the first ink supply tube 160. The second to the fourth ink storage bodies 131 to 133 communicate with the liquid ejecting head 147 via the second to the fourth ink outlet tubes 138 to 140, the adapters 164, and the second to the fourth ink supply tubes 161 to 163.

A wall-shaped partitioning portion 151 is provided upright on the upper side in the housing 114 so as to extend in the left-right direction. The partitioning portion 151 partitions a first region A2 from a second region B2. The first region A2 does not include the movement region of the carriage 146, and the second region B2 does include the movement region of the carriage 146.

The first to the fourth ink supply tubes 160 to 163 are flexible, extend from the ink supply needle 165 toward the partitioning portion 151, and extend to the first ink storage portion 120 along the surface of the rear side (the second region B2 side) of the partitioning portion 151. Subsequently, the first to the fourth ink supply tubes 160 to 163 extend to the liquid ejecting head 147, which is supported by the carriage 146, bending so as to bulge to the first ink storage portion 120 side while heading toward the movement region of the carriage 146 from the surface of the second region B2 side of the partitioning portion 151.

The first ink outlet tube 126 is disposed so as to pass through the through holes 122*a* and 114*a* from the first ink outlet portion 125 toward the downstream side in relation to the flow of the ink, to extend in the left-right direction along the surface of the front side (the first region A2 side) of the partitioning portion 151. The first ink outlet tube 126 is disposed on the right side of the partitioning portion 151 with the orientation changed so as to extend to the front side, and is connected to the front side of the adapter 164.

Figure 16A:
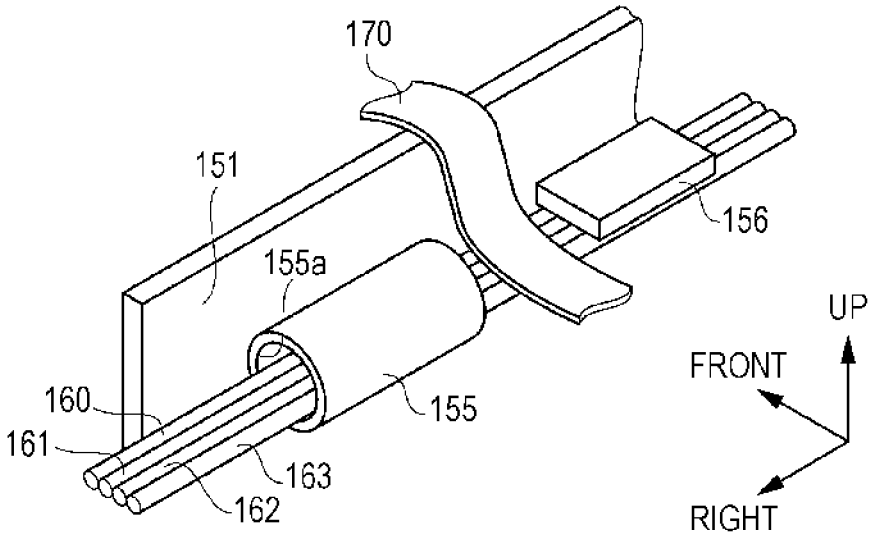
FIG. 16A is a perspective view of a portion at which a fixing member and a movement restriction member are provided.

FIG. 16A is a perspective view of a portion at which a fixing member 155 and a movement restriction member 156 are provided. The fixing member 155 and the movement restriction member 156 are provided on the rear side of the partitioning portion 151. The fixing member 155 is a cylindrical member which includes a through hole 155*a*. The first to the fourth ink supply tubes 160 to 163 are disposed to pass through the through hole 155*a*. Accordingly, the fixing member 155 fixes the first to the fourth ink supply tubes 160 to 163.

The movement restriction member 156 is a plate-shaped member, and is fixed to the partitioning portion 151, oriented to protrude from the partitioning portion 151 to the rear side. The first to the fourth ink supply tubes 160 to 163 are disposed to pass under the movement restriction member 156. Accordingly, the movement restriction member 156 restricts the first to the fourth ink supply tubes 160 to 163 from moving upward.

A range of the first to the fourth ink supply tubes 160 to 163 spanning from the portions which are connected to the carriage 146 to the portions at which movement is restricted by the movement restriction member 156 deform to track the reciprocal movement of the carriage 146 of FIG. 14. The portions of the first to the fourth ink supply tubes 160 to 163 which are subjected to tracking deformation are the deforming movable portions HK2 of the liquid supply tubes. The surface of the rear side of the partitioning portion 151 is a bearing portion 151*a* which bears the deforming movable portions HK2 when the deforming movable portions HK2 deform to track the reciprocal movement of the carriage 146.

The deforming movable portions HK2 of the first to the fourth ink supply tubes 160 to 163 are disposed to be partitioned from the first ink outlet tube 126 by the partitioning portion 151.

Figure 17:
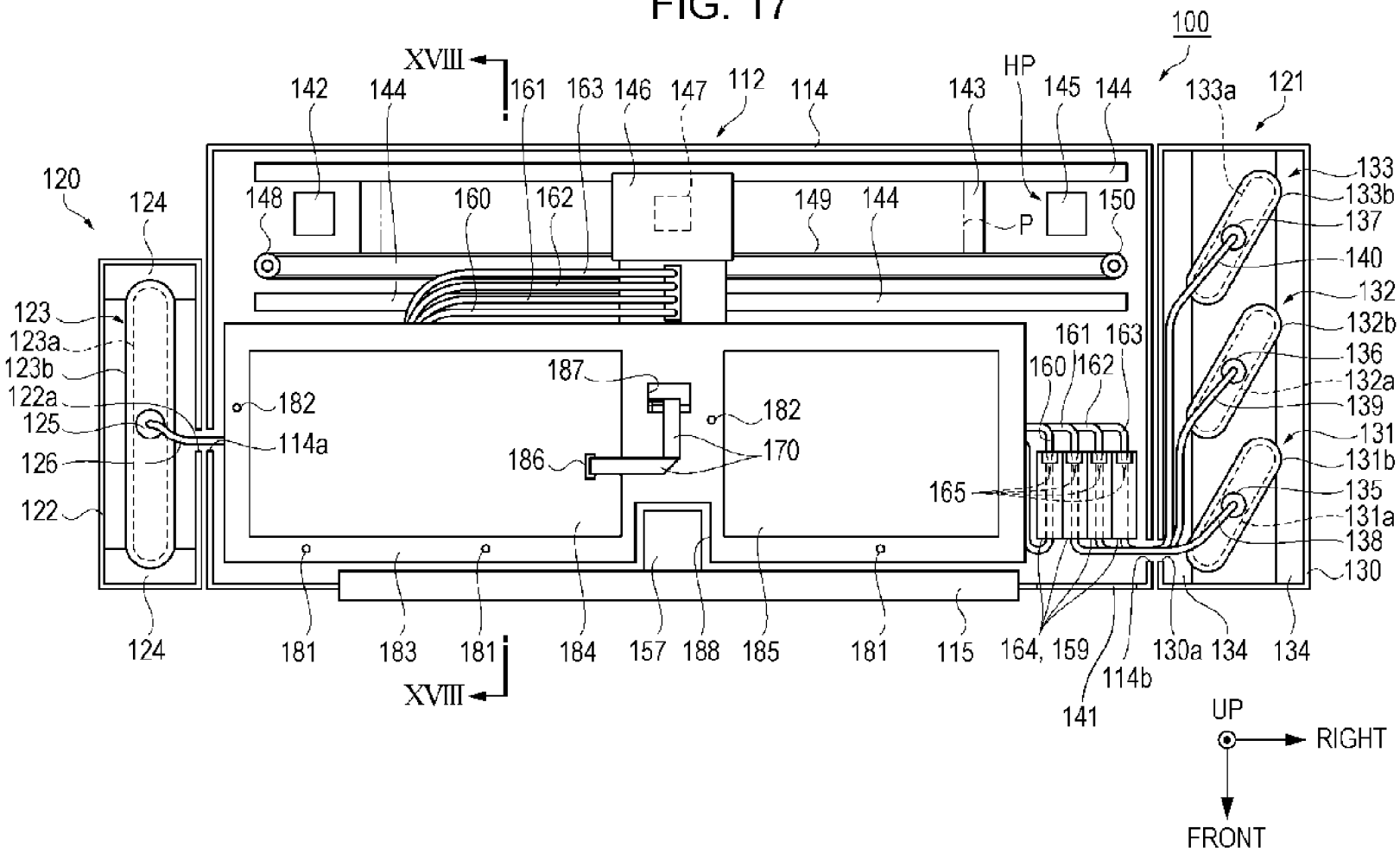
FIG. 17 is a cross-sectional schematic plan view illustrating a state in which a substrate disposition portion, in which substrates are disposed, is provided inside the ink jet printer according to the second embodiment.

FIG. 17 is a cross-sectional schematic plan view illustrating a state in which a substrate disposition portion 183, in which substrates 184 and 185 are disposed, is provided inside the housing 114 of the ink jet printer 112 according to the present embodiment. Circuits (not shown) are formed on the substrates 184 and 185, and electrical components (not shown) are mounted thereon.

A plurality of prismatic mounting portions 180 which are provided upright on the upper side, and protruding portions 181 protruding upward from the mounting portions 180 are provided on the front surface side in the housing 114 of FIG. 14. A plurality of protruding portions 182 are provided on the upper portion of the partitioning portion 151 to protrude upward.

The lower surface of the substrate disposition portion 183 of FIG. 17 abuts the top surfaces of the mounting portion 180 and the partitioning portion 151 of FIG. 14, and the protruding portions 181 and 182 each penetrate the substrate disposition portion 183 and engage with the substrate disposition portion 183.

Figure 18:
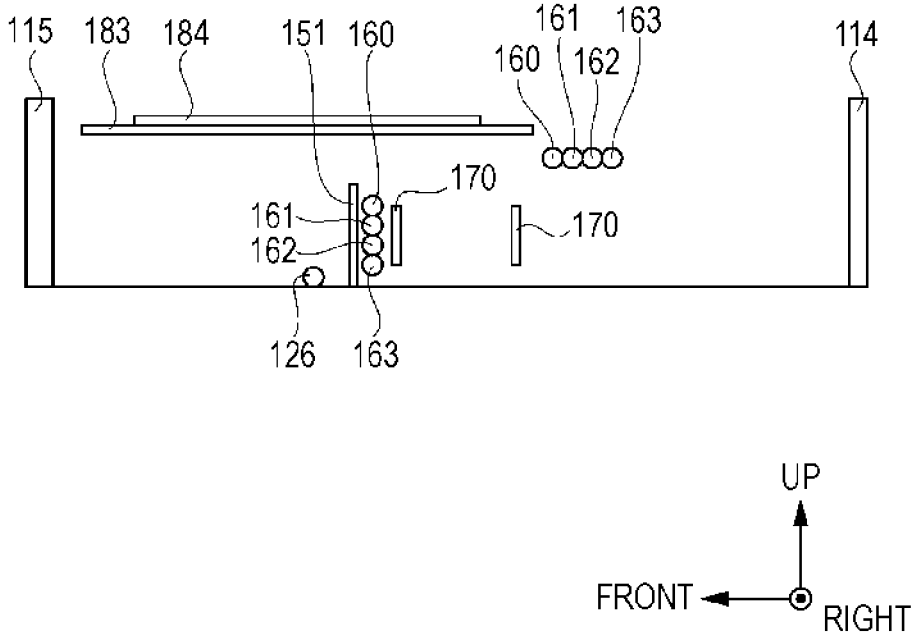
FIG. 18 is a diagram illustrating the substrate, which is provided above the portion of the liquid supply tube which is not subjected to tracking deformation, and the substrate disposition portion.

FIG. 18 is a diagram illustrating the disposition in the vertical direction of the substrate disposition portion 183 as seen from the right side, and is a cross-sectional diagram taken along the line XVIII-XVIII of FIG. 17. The substrate disposition portion 183 on which the substrate 184 is mounted is provided above the partitioning portion 151, the first ink outlet tube 126, the first to the fourth ink supply tubes 160 to 163, and the FFC 170.

The substrate disposition portion 183 is positioned to overlap the first ink outlet tube 126, which does not deform to track the reciprocal movement of the carriage 146, in both the front-rear direction and the left-right direction. Therefore, when viewed from above, the first ink outlet tube 126 is positioned to be hidden by the substrate disposition portion 183.

One end of the FFC 170 is connected to the liquid ejecting head 147 in a state of being supported by the carriage 146 of FIG. 14. The other end of the FFC 170 of FIG. 17 passes through an opening portion 187 provided in the substrate disposition portion 183, and is connected to a connector 186 provided on the substrate 184. The FFC 170 supplies power to the liquid ejecting head 147, transmits and receives various signals to and from the liquid ejecting head 147 side, and the like.

The one end of the FFC 170 which is connected to the connector 186 of the substrate 184 passes over the portions of the first to the fourth ink supply tubes 160 to 163 which are not subjected to tracking deformation with the orientation changed from the left-right direction to the front-rear direction by being folded. In other words, the portions of the first to the fourth ink supply tubes 160 to 163 which are not subjected to tracking deformation are disposed to pass under the FFC 170.

The FFC 170 which extends in the front-rear direction over the substrate disposition portion 183 passes through the opening portion 187, is folded at the rear side of the partitioning portion 151 to change orientation to the left-right direction, and is disposed along the rear side of the partitioning portion 151.

Figure 16B:
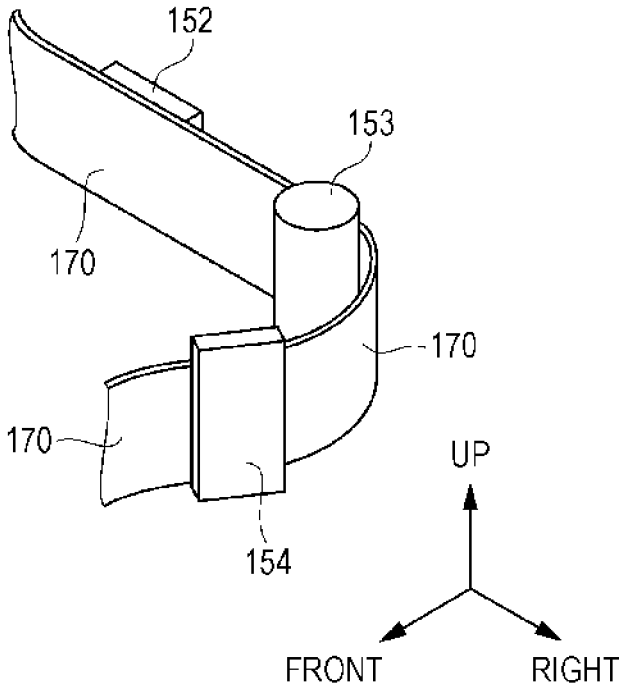
FIG. 16B is a perspective view of a portion at which movement restriction members which restrict the movement of an FFC are provided.

FIG. 16B is a perspective view of a portion at which movement restriction members 152, 153, and 154 which restrict the movement of an FFC 170 are provided. The movement restriction members 152 and 154 are plate-shaped members provided upright on the upper side. The movement restriction member 153 is a cylindrical member provided upright on the upper side.

The FFC 170 passes between the movement restriction member 152 and the movement restriction member 153, and between the movement restriction member 153 and the movement restriction member 154 in a state of being in contact with the respective movement restriction members; thus, movement of the FFC 170 in the vertical direction and the horizontal direction (the left-right direction and the front-rear direction) is restricted.

The FFC 170 extends along the inside (the second ink storage portion 121 side) of the first to the fourth ink supply tubes 160 to 163, which bend from the surface of the rear side of the partitioning portion 151, bending so as to bulge to the first ink storage portion 120 side. The FFC 170 subsequently extends to the liquid ejecting head 147, which is supported by the carriage 146.

A notch portion 188 which is open to the front side is provided in the substrate disposition portion 183, and the inclination mechanism 157 is disposed in a state in which the upper portion thereof protrudes above the notch portion 188.

In the ink jet printer 112 of FIG. 14 described above in the present embodiment, the substrate disposition portion 183 is disposed above the first ink outlet tube 126 which does not deform to track the reciprocal movement of the carriage 146. Therefore, since the substrate disposition portion 183 can be configured as the cover member which hides the first ink outlet tube 126, the appearance when viewing the inside of the housing 114 is improved.

Third Embodiment

Figure 19:
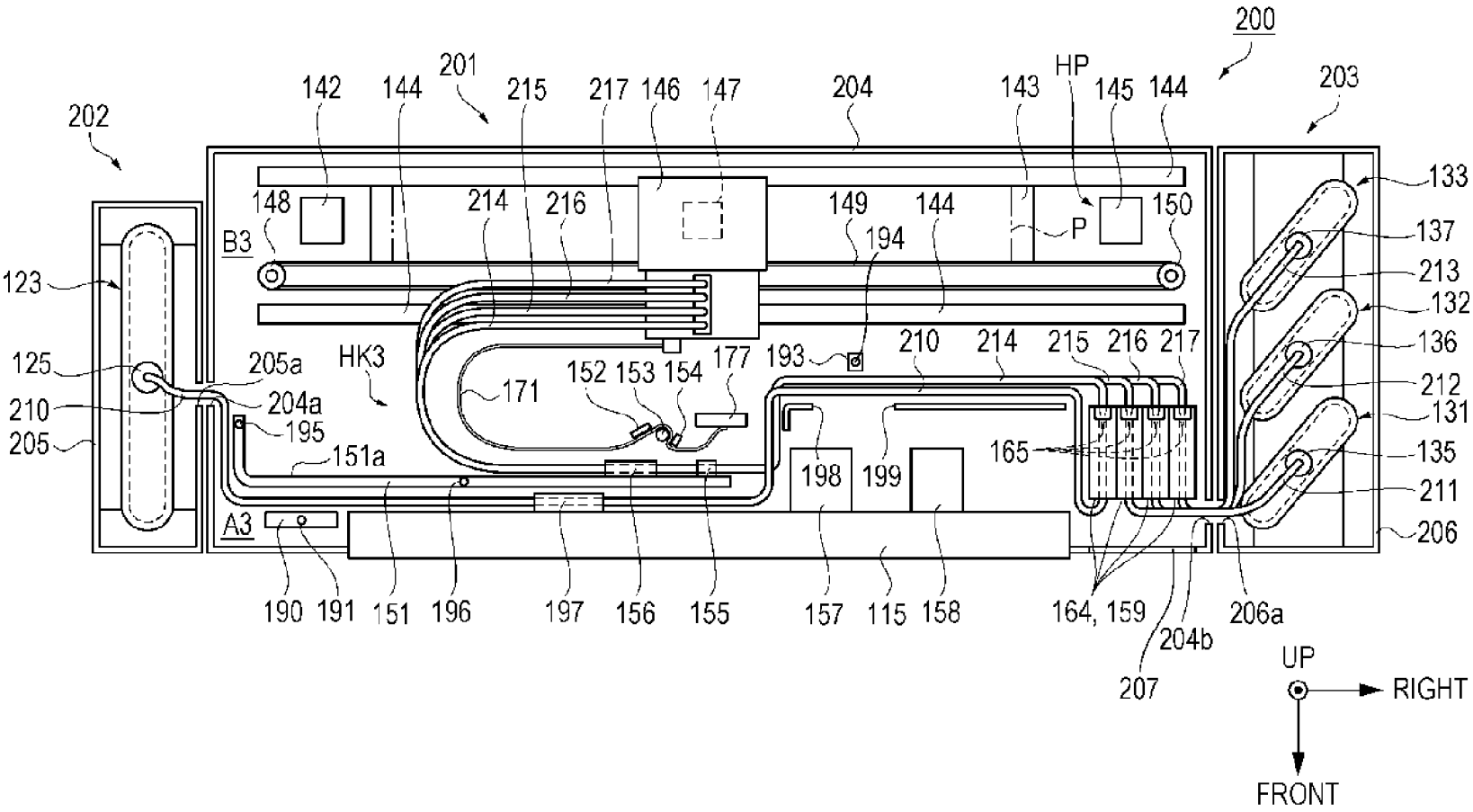
FIG. 19 is a cross-sectional schematic plan view illustrating the inside of an ink jet printer according to a third embodiment.

In the third embodiment, description will be given of an ink jet printer in which the portions of the liquid supply tubes which are not subjected to tracking deformation are disposed in positions which overlap the connecting portion of the liquid supply tubes and the inclination mechanism of the operation panel. FIG. 19 is a cross-sectional schematic plan view illustrating the inside of an ink jet printer 201 which is provided in a multi-function printer 200 of the present embodiment.

In the same manner as the ink jet printer 112 described in the second embodiment, the carriage 146 on which the liquid ejecting head 147 is mounted, the drive pulley 148, and the timing belt 149 which is wound around the follower pulley 150 are provided inside a housing 204 of the ink jet printer 201. When the drive pulley 148 is rotationally driven by the driving of the carriage motor (not shown), the drive force is transmitted to the carriage 146 via the timing belt 149, and the carriage 146 moves reciprocally in the left-right direction along the pair of guide rails 144.

In the same manner as the ink jet printer 112 of the second embodiment, the flushing box 142 for receiving the flushed ink, and the cap 145 for performing maintenance such as cleaning of the liquid ejecting head 147 which is disposed in the home position HP region are provided inside the housing 204 of the ink jet printer 201.

The printing onto the paper P is carried out by ejecting each color of ink onto the paper P on the support stand 143 from a plurality of nozzles (not shown) which are open on the lower surface of the liquid ejecting head 147 while the carriage 146 moves in the left-right direction.

A first ink storage portion 202 is provided on the left side on the outside of the housing 204, and a second ink storage portion 203 is provided on the right side. The first ink storage body 123 described in the second embodiment is stored inside a first case 205 of the first ink storage portion 202, and the second to the fourth ink storage bodies 131 to 133 described in the second embodiment are stored inside a second case 206 of the second ink storage portion 203. A monochrome ink is stored in the first ink storage body 123, and a yellow ink, a magenta ink, and a cyan ink are respectively stored in the second to the fourth ink storage bodies 131 to 133.

A cap 207 which is capable of rotating is provided on the front surface side of the housing 204, and the tube connecting portion 159 which is configured from the four adapters 164 is provided on the rear side of the cap 207.

A first ink outlet tube 210 is disposed as the liquid supply tube to pass through a through hole 205*a* of the first case 205 and a through hole 204*a* of the housing 204, one end of the first ink outlet tube 210 is connected to the first ink outlet portion 125 of the first ink storage body 123, and the other end is connected to the adapter 164.

Second to fourth ink outlet tubes 211 to 213 are disposed as the liquid supply tubes to pass through a through hole 206*a* of the second case 206 and a through hole 204*b* of the housing 204, one end of the second to the fourth ink outlet tubes 211 to 213 is respectively connected to the second to the fourth ink outlet portions 135 to 137 of the second to the fourth ink storage bodies 131 to 133, and the other end is connected to the adapter 164.

One end of the first to the fourth ink supply tubes 214 to 217, which are the liquid supply tubes, is connected to the adapter 164, and the other end is supported by the carriage 146 and connected to the liquid ejecting head 147.

According to this configuration, the inks which are stored in the first ink storage body 123 and the second to the fourth ink storage bodies 131 to 133 are supplied to the liquid ejecting head 147 via the adapters 164 provided with the first to the fourth ink outlet tubes 210 to 213, and the ink supply needles 165, and the first to the fourth ink supply tubes 214 to 217.

The wall-shaped partitioning portion 151 is provided upright on the upper side so as to extend in the left-right direction. The partitioning portion 151 partitions a first region A3 from a second region B3. The first region A3 does not include the movement region of the carriage 146, and the second region B3 does include the movement region of the carriage 146.

The first ink outlet tube 210 is disposed so as to pass through the through holes 205*a* and 204*a* from the first ink outlet portion 125 toward the downstream side in relation to the flow of the ink, and is disposed to pass between the partitioning portion 151 and the operation panel 115 so as to extend in the left-right direction along the surface of the front side (the first region A3 side) of the partitioning portion 151. The movement of the first ink outlet tube 210 to the front side is restricted by a mounting portion 190 described later, and the movement to the upper side is restricted due to the first ink outlet tube 210 passing under an extending portion 197 which extends in the left-right direction.

The first ink outlet tube 210 is disposed on the right side of the partitioning portion 151 to extend to the rear side, changes orientation at the position of the rear side of the inclination mechanism 157 and a buzzer unit 158 to extend in the left-right direction, changes orientation again to extend to the front side, and is connected to the front side of the adapter 164.

The first to the fourth ink supply tubes 214 to 217 which are connected to the rear side of the adapters 164 are disposed to extend in the left-right direction at a position on the rear side of the inclination mechanism 157 and the buzzer unit 158, change orientation and are disposed to extend to the front side at a position on the left side of the inclination mechanism 157, and are disposed to extend along the surface of the rear side (the second region B3 side) of the partitioning portion 151.

The portions of the first to the fourth ink supply tubes 214 to 217 which deform to track the reciprocal movement of the carriage 146 are defined as deforming movable portions HK3 of the liquid supply tubes. The surface of the rear side of the partitioning portion 151 is the bearing portion 151*a* which bears the deforming movable portions HK3 when the deforming movable portions HK3 deform to track the reciprocal movement of the carriage 146.

In the present embodiment, the deforming movable portions HK3 of the first to the fourth ink supply tubes 214 to 217 are partitioned from the first ink outlet tube 210 by the partitioning portion 151.

The fixing member 155 through which the first to the fourth ink supply tubes 214 to 217 pass is provided on the rear side of the partitioning portion 151, and the movement of the first to the fourth ink supply tubes 214 to 217 is restricted by the fixing member 155.

The movement restriction member 156 is provided on the rear side of the partitioning portion 151, and the upward movement of the first to the fourth ink supply tubes 214 to 217 is restricted by disposing the first to the fourth ink supply tubes 214 to 217 under the movement restriction member 156.

Figure 20:
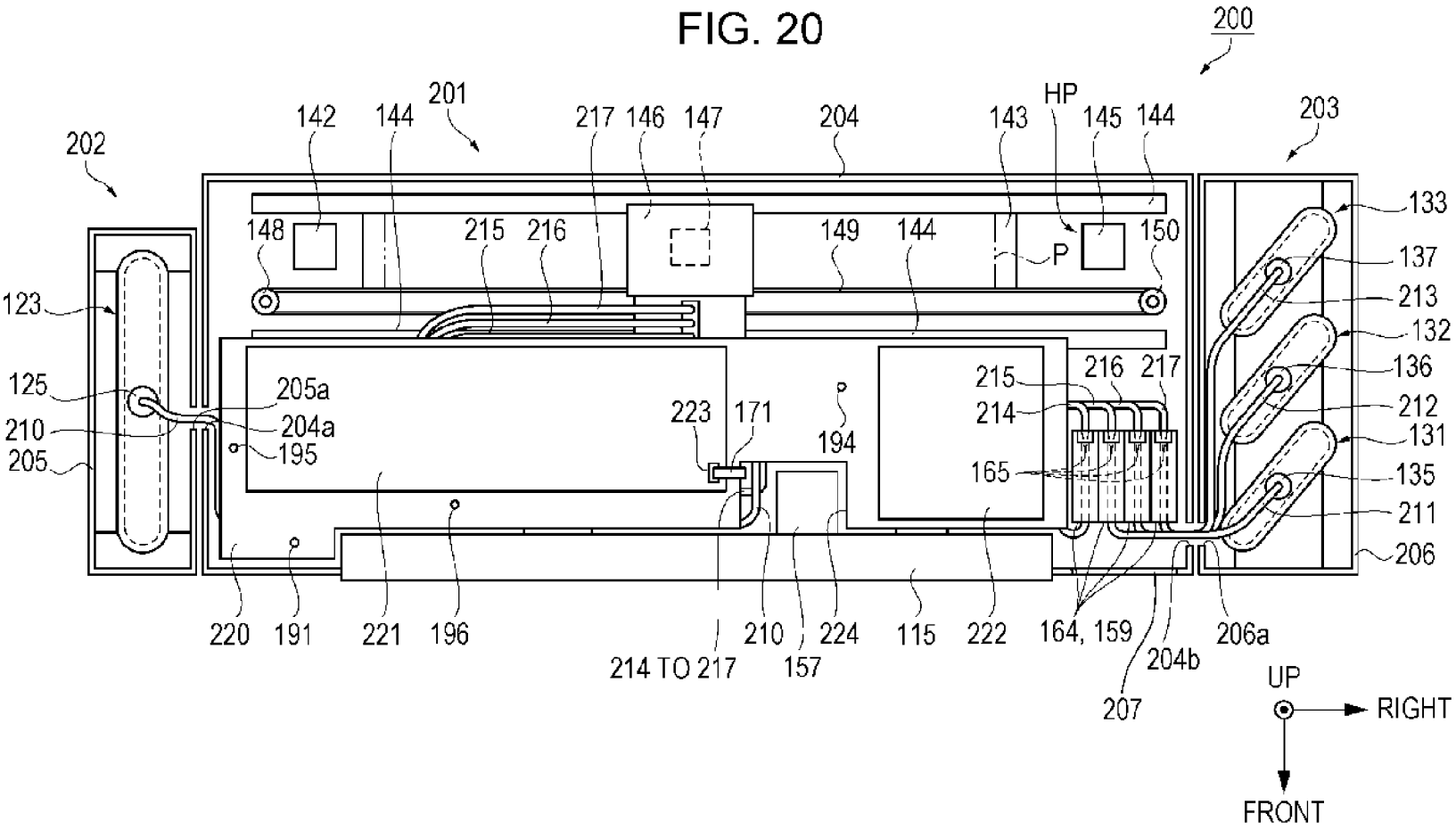
FIG. 20 is a cross-sectional schematic plan view illustrating a state in which the substrate disposition portion, in which the substrates are disposed, is provided inside the ink jet printer according to the third embodiment.

FIG. 20 is a cross-sectional schematic plan view illustrating a state in which the substrate disposition portion 220, in which the substrates 221 and 222 are disposed, is provided inside the housing 204 of the ink jet printer 201 according to the present embodiment. Circuits (not shown) are formed on the substrates 221 and 222, and electrical components (not shown) are mounted thereon.

A wall-shaped mounting portion 190 which is provided upright on the upper side, and protruding portions 191 protruding upward from the mounting portion 190 are provided on the front surface side in the housing 204 of FIG. 19. A protruding portions 195 and 196 are provided on the upper portion of the partitioning portion 151 to protrude upward. A prismatic mounting portion 193 with a protruding portion 194 is provided in front of the guide rail 144 at a center portion in the housing 204 in a position which does not interfere with the reciprocal movement of the carriage 146.

The lower surface of the substrate disposition portion 220 of FIG. 20 abuts the top surfaces of the mounting portions 190 and 193 and the partitioning portion 151 of FIG. 19, and the protruding portions 191, 194, 195, and 196 each penetrate the substrate disposition portion 220 and engage with the substrate disposition portion 220.

The substrate disposition portion 220 of FIG. 20 is provided above the partitioning portion 151, the first ink outlet tube 210, the first to the fourth ink supply tubes 214 to 217, and an FFC 171 of FIG. 19.

One end of the FFC 171 is connected to the liquid ejecting head 147 in a state of being supported by the carriage 146. The other end of the FFC 171 passes through a notch portion 224 provided in the substrate disposition portion 220, and is connected to a connector 223 provided on the substrate 221. The FFC 171 supplies power to the liquid ejecting head 147, transmits and receives various signals to and from the liquid ejecting head 147 side, and the like.

The FFC 171 passes between the movement restriction member 152 and the movement restriction member 153, and between the movement restriction member 153 and the movement restriction member 154 in a state of being in contact with the respective movement restriction members; thus, movement of the FFC 171 is restricted (refer to FIG. 16B).

The FFC 171 is disposed on the inside (the second ink storage portion 203 side) of the deforming movable portions HK3 of the first to the fourth ink supply tubes 214 to 217, and deforms to track the reciprocal movement of the liquid ejecting head 147 (the carriage 146).

The notch portion 224 which is open to the front side is provided in the substrate disposition portion 220, and the inclination mechanism 157 is disposed in a state in which the upper portion thereof passes through the notch portion 224. As illustrated in FIG. 20, the first ink outlet tube 210 and the first to the fourth ink supply tubes 214 to 217 are disposed in a state such that a portion thereof is exposed from the notch portion 224.

The first ink outlet tube 210, which is the portion of the ink supply tube which does not deform to track the reciprocal movement of the carriage 146, is disposed in a position which overlaps the inclination mechanism 157 in a direction (the front-rear direction) which intersects the direction (the left-right direction) of reciprocal movement of the carriage 146.

According to this configuration, it is possible to dispose the portions (the deforming movable portions HK3) of the first to the fourth ink supply tubes 214 to 217 which deform to track the reciprocal movement of the carriage 146 such that the length of the portions in the front-rear direction is increased. Therefore, it is possible to dispose the first to the fourth ink supply tubes 214 to 217 such that the curvature of the deforming movable portions HK3 is small. Accordingly, since it is possible to reduce the restoring force of the deforming movable portions HK3, it is possible to suppress the influence of the restoring force on the reciprocal movement speed of the carriage. Therefore, it is possible to suppress the reduction in quality of an image which is formed on the paper P by ejecting the ink from the liquid ejecting head 147 which moves reciprocally.

A configuration may be adopted in which the ink jet printer 12 of the first embodiment is provided with an operation panel capable of inclining, and an inclination mechanism which defines the inclination angle of the operation panel, and the first ink outlet tube 26 which does not deform to track the reciprocal movement of the carriage 46 is disposed in a position which overlaps the inclination mechanism in a direction which intersects the direction of the reciprocal movement of the carriage 46.

Fourth Embodiment

Figure 21:
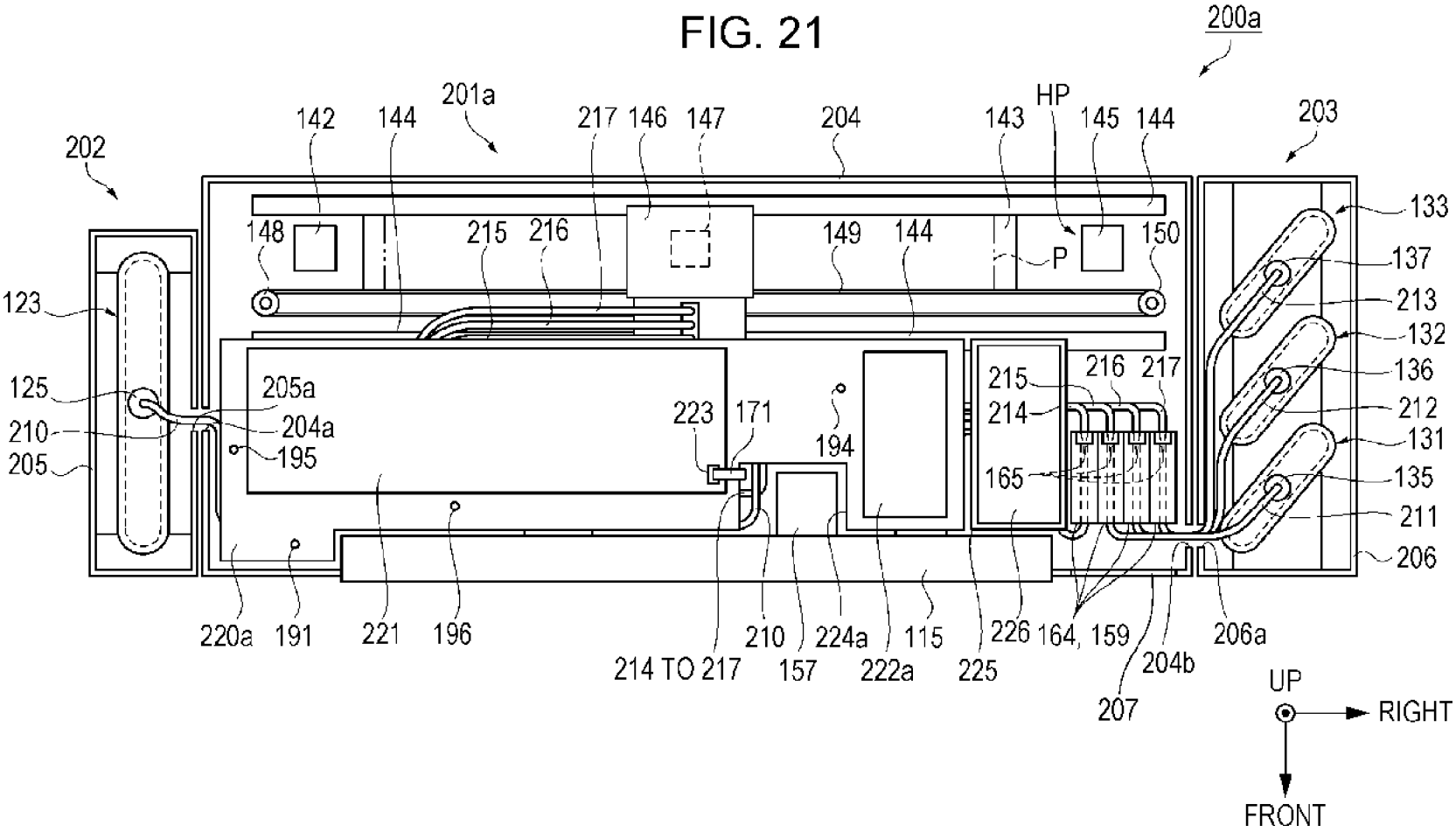
FIG. 21 is a cross-sectional schematic plan view illustrating a state in which the substrate, the substrate disposition portion, and an absorbent material are provided inside the ink jet printer according to a fourth embodiment.

In the fourth embodiment, description is given of an ink jet printer provided with an absorbent material above the liquid supply tubes. FIG. 21 is a cross-sectional schematic plan view illustrating the inside of an ink jet printer 201*a* which is provided in a multi-function printer 200*a* of the present embodiment.

In the ink jet printer 201*a* of the present embodiment, a substrate disposition portion 220*a* in which substrates 221 and 222*a* of FIG. 21 are disposed, and an absorbent material disposition portion 225 in which an absorbent material 226 is disposed are provided inside the housing 204 of FIG. 19, which is described in the third embodiment.

When so-called borderless printing, in which printing is carried out without providing margins on the outer border portion of the paper P, is performed, the ink which is discharged from the liquid ejecting head 147 to the outside of the paper P is absorbed by the absorbent material 226.

The substrate disposition portion 220*a* is provided above the partitioning portion 151, the first ink outlet tube 210, the first to the fourth ink supply tubes 214 to 217, and the FFC 171 of FIG. 19. The absorbent material disposition portion 225 of FIG. 21 is provided above the first ink outlet tube 210, and the first to the fourth ink supply tubes 214 to 217 of FIG. 19 on the right side of the substrate disposition portion 220*a*.

The FFC 171 passes through a notch portion 224*a* provided in the substrate disposition portion 220*a*, and is connected to the connector 223 provided on the substrate 221.

According to this configuration, since it is possible to increase the length of the deforming movable portions HK3 in the front-rear direction, it is possible to reduce the curvature of the deforming movable portions HK3 and to reduce the restoring force of the deforming movable portions HK3. Accordingly, since it is possible to suppress the influence of the restoring force on the movement speed of the carriage 146, it is possible to suppress the reduction in quality of an image which is formed by discharging the ink from the liquid ejecting head 147.

The entire disclosure of Japanese Patent Application No.: 2013-265010, filed Dec. 24, 2013 and 2014-029350, filed Feb. 19, 2014 are expressly incorporated by reference herein.

What is claimed is:

1. A recording apparatus, comprising:

a housing;

a liquid ejecting head which is supported by a carriage provided to be capable of moving reciprocally within the housing and which performs recording by ejecting a liquid onto a recording medium;

a liquid supply tube which guides the liquid which is stored in a liquid storage portion disposed on an outside of the housing to the liquid ejecting head, the liquid ejecting head side of which deforms to track the reciprocal movement of the liquid ejecting head, and the liquid storage portion side of which is folded back from the liquid ejecting head side and is not subjected to tracking deformation;

a bearing portion which bears a portion of the liquid supply tube which is subjected to tracking deformation; and a partitioning portion which is provided in a region in which the portion of the liquid supply tube which is subjected to tracking deformation and a portion of the liquid supply tube which is not subjected to tracking deformation are disposed running along each other, and partitions the portion of the liquid supply tube which is subjected to tracking deformation from the portion of the liquid supply tube which is not subjected to tracking deformation.

2. The recording apparatus according to claim 1, wherein the bearing portion is also used as the partitioning portion.

3. The recording apparatus according to claim 1, wherein there is a plurality of the liquid supply tubes, and wherein the plurality of liquid supply tubes are connected via a connecting portion.

4. The recording apparatus according to claim 3, wherein the portion of the liquid supply tube which is not subjected to tracking deformation is disposed in a position which overlaps the connecting portion in a direction which intersects the direction of the reciprocal movement of the carriage.

5. The recording apparatus according to claim 1, wherein a substrate disposition portion in which a substrate is disposed is provided in the housing, and wherein the portion of the liquid supply tube which is not subjected to tracking deformation is disposed so as to pass between the partitioning portion and the substrate disposition portion.

6. The recording apparatus according to claim 5, wherein a movement restriction member, which restricts the portion of the liquid supply tube which is not subjected to tracking deformation from moving to the side of the portion of the liquid supply tube which is subjected to tracking deformation, is provided between the partitioning portion and the substrate disposition portion.

7. The recording apparatus according to claim 6, further comprising:

a cable which supplies power to the liquid ejecting head, wherein the movement restriction member is a ferrite core which reduces electromagnetic wave noise of the cable.

8. The recording apparatus according to claim 5, further comprising:

a cable which supplies power to the liquid ejecting head, wherein the cable is connected to the substrate, and the portion of the liquid supply tube which is not subjected to tracking deformation is disposed to pass under the cable.

9. The recording apparatus according to claim 5, wherein a movement restriction wall, which restricts the portion of the liquid supply tube which is not subjected to tracking deformation from moving to the substrate disposition portion side, is provided between the portion of the liquid supply tube which is not subjected to tracking deformation and the substrate disposition portion.

10. The recording apparatus according to claim 5, wherein the liquids from the plurality of liquid storage portions in which of different types of liquid are stored are guided to the liquid ejecting head by the plurality of liquid supply tubes, and wherein one of the portions of the plurality of liquid supply tubes which is not subjected to tracking deformation is disposed so as to pass between the partitioning portion and the substrate disposition portion.

11. The recording apparatus according to claim 5, wherein the liquids from the plurality of liquid storage portions in which different types of liquid are stored are guided to the liquid ejecting head by the plurality of liquid supply tubes, and wherein the portions of the plurality of liquid supply tubes which are not subjected to tracking deformation are formed integrally in a lined-up state and are disposed so as to pass between the partitioning portion and the substrate disposition portion.

12. The recording apparatus according to claim 1, wherein a cover member is disposed above the portion of the liquid supply tube which is not subjected to tracking deformation in the housing.

13. The recording apparatus according to claim 12, wherein the cover member is the substrate disposition portion.

14. The recording apparatus according to claim 1, further comprising:

an operation panel capable of inclining into which information relating to recording is input; and an inclination mechanism which defines an inclination angle of the operation panel, wherein the portion of the liquid supply tube which is not subjected to tracking deformation is disposed in a position which overlaps the inclination mechanism in a direction which intersects the direction of the reciprocal movement of the carriage.

15. The recording apparatus according to claim 1, wherein the liquids from the plurality of liquid storage portions in which different types of liquid are stored are guided to the liquid ejecting head by the plurality of liquid supply tubes, and wherein one of the portions of the plurality of liquid supply tubes which is not subjected to tracking deformation is disposed to run along an opposite side of the partitioning portion from the portions of the liquid supply tubes which are subjected to tracking deformation.

16. The recording apparatus according to claim 1, wherein the liquids from the plurality of liquid storage portions in which different types of liquid are stored are guided to the liquid ejecting head by the plurality of liquid supply tubes, and wherein the portions of the plurality of liquid supply tubes which are not subjected to tracking deformation are formed integrally in a lined-up state and are disposed to run along an opposite side of the partitioning portion from the portions of the liquid supply tubes which are subjected to tracking deformation.

17. A recording apparatus, comprising:

a housing;

a liquid ejecting head which is supported by a carriage provided to be capable of moving reciprocally within the housing and which performs recording by ejecting a liquid onto a recording medium;

a liquid supply tube which guides the liquid which is stored in a liquid storage portion disposed on an outside of the housing to the liquid ejecting head, the liquid ejecting head side of which deforms to track the reciprocal movement of the liquid ejecting head, and the liquid storage portion side of which is folded back from the liquid ejecting head side and is not subjected to tracking deformation;

a cable which deforms to track the reciprocal movement of the liquid ejecting head and supplies power to the liquid ejecting head;

a bearing portion which bears the cable; and a partitioning portion which is provided in a region in which the cable and the portion of the liquid supply tube which is not subjected to tracking deformation are disposed running along each other, and partitions the cable from the portion of the liquid supply tube which is not subjected to tracking deformation.

18. A recording apparatus, comprising:

a housing;

a liquid ejecting head which is supported by a carriage provided to be capable of moving reciprocally within the housing and which performs recording by ejecting a liquid onto a recording medium;

a liquid supply tube which guides the liquid which is stored in a liquid storage portion disposed on an outside of the housing to the liquid ejecting head, the liquid ejecting head side of which deforms to track the reciprocal movement of the liquid ejecting head, and the liquid storage portion side of which is folded back from the liquid ejecting head side and is not subjected to tracking deformation;

a protective member which deforms to track the reciprocal movement of the liquid ejecting head and protects the portion of the liquid supply tube which is subjected to tracking deformation;

a bearing portion which bears the protective member; and a partitioning portion which is provided in a region in which the protective member and the portion of the liquid supply tube which is not subjected to tracking deformation are disposed running along each other, and partitions the protective member from the portion of the liquid supply tube which is not subjected to tracking deformation.

* * * * *